US010960292B2

(12) United States Patent
Stasson et al.

(10) Patent No.: US 10,960,292 B2
(45) Date of Patent: Mar. 30, 2021

(54) CARD HANDLING DEVICES INCLUDING MULTI-CARD STORAGE COMPARTMENTS, AND RELATED METHODS

(71) Applicant: SG Gaming, Inc, Las Vegas, NV (US)

(72) Inventors: James B. Stasson, Chaska, MN (US); Attila Grauzer, Las Vegas, NV (US); Robert J. Rynda, Las Vegas, NV (US); Paul K. Scheper, Bloomington, MN (US); Ronald R. Swanson, Otsego, MN (US)

(73) Assignee: SG Gaming, Inc., Las Vegas, NV (US)

( * ) Notice: Subject to any disclaimer, the term of this patent is extended or adjusted under 35 U.S.C. 154(b) by 0 days.

(21) Appl. No.: 16/889,491

(22) Filed: Jun. 1, 2020

(65) Prior Publication Data

US 2020/0289914 A1 Sep. 17, 2020

Related U.S. Application Data

(63) Continuation of application No. 14/575,768, filed on Dec. 18, 2014, now Pat. No. 10,668,361, which is a (Continued)

(51) Int. Cl.
*A63F 1/12* (2006.01)

(52) U.S. Cl.
CPC ..... *A63F 1/12* (2013.01); *H05K 999/00* (2013.01); *H05K 999/99* (2013.01)

(58) Field of Classification Search
USPC ..... 273/149 R
See application file for complete search history.

(56) References Cited

U.S. PATENT DOCUMENTS 2,747,877 A 5/1956 Howard
3,185,482 A 5/1965 Russell
(Continued)

FOREIGN PATENT DOCUMENTS

CN 1383099 A 12/2002
CN 1824356 A 8/2006
(Continued)

OTHER PUBLICATIONS

"TableScanner (TM) from ADVANSYS", Casino Inside Magazine, No. 30, pp. 34-36 (Dec. 2012) (4 pages).
(Continued)

*Primary Examiner* — John E Simms, Jr.
*Assistant Examiner* — Dolores R Collins
(74) *Attorney, Agent, or Firm* — TraskBritt

(57) ABSTRACT

Card-handling devices may include a card input mechanism and a temporary card storage area positioned to receive cards from the card input mechanism. The temporary card storage area may include storage compartments distributed longitudinally along a rack. A card output mechanism may be configured to eject cards from the temporary card storage area. A card size adjustment member may be attached to the rack and extending along a lateral side of each storage compartment. The card size adjustment member may be movable between a first lateral position in which the card size adjustment member defines a first width of each of the storage compartments and a second lateral position in which the card size adjustment member defines a second, different width of each of the storage compartments.

20 Claims, 21 Drawing Sheets

Related U.S. Application Data continuation of application No. 13/560,792, filed on Jul. 27, 2012, now Pat. No. 8,960,674.

(56) References Cited

U.S. PATENT DOCUMENTS

| | | | | |
|---|---|---|---|---|
| 4,457,512 | A | 7/1984 | Stevenson | |
| 5,004,218 | A | 4/1991 | Sardano et al. | |
| 6,588,750 | B1 * | 7/2003 | Grauzer | A63F 1/12 273/149 R |
| 8,960,674 | B2 * | 2/2015 | Stasson | A63F 1/12 273/149 R |
| 10,124,241 | B2 | 11/2018 | Stasson et al. | |
| 10,486,055 | B2 | 11/2019 | Kelly et al. | |
| 10,668,361 | B2 * | 6/2020 | Stasson | H05K 999/99 |
| 2011/0230148 | A1 | 9/2011 | Demuynck et al. | |
| 2014/0027979 | A1 * | 1/2014 | Stasson | A63F 1/12 273/149 R |
| 2015/0251079 | A1 | 9/2015 | Wright | |

FOREIGN PATENT DOCUMENTS

| | | | |
|---|---|---|---|
| CN | 1933881 | A | 3/2007 |
| CN | 2877425 | Y | 3/2007 |
| CN | 101025603 | A | 8/2007 |
| CN | 101134141 | A | 3/2008 |
| CN | 201132058 | Y | 10/2008 |
| CN | 101437586 | A | 5/2009 |
| CN | 102125756 | A | 7/2011 |
| CN | 102170944 | A | 8/2011 |
| CN | 102847311 | A | 1/2013 |
| CN | 202724641 | U | 2/2013 |
| DE | 0291230 | C | 4/1916 |
| DE | 2816377 | A1 | 10/1979 |
| GB | 0289552 | A | 4/1928 |
| JP | 2003-154320 | A | 5/2003 |
| JP | 2006-092140 | A | 4/2006 |
| JP | 4586474 | B2 | 11/2010 |
| TW | M335308 | U | 7/2008 |
| TW | M357307 | U | 5/2009 |
| TW | I345476 | B | 7/2011 |
| WO | 2003/004116 | A1 | 1/2003 |
| WO | 2012/053074 | A1 | 4/2012 |

OTHER PUBLICATIONS

Australian Examination Report for Australian Application No. 2010202856, dated Aug. 11, 2011, 2 pages.

Australian Provisional Patent Application for Australian Patent Application No. PM7441, filed Aug. 15, 1994, Applicants: Rodney G. Johnson et al., Tille: Card Handling Apparatus, 13 pages.

Canadian Office Action for CA 2,580,309 dated Mar. 20, 2012 (6 pages).

Canadian Office Action for Canadian Application No. 2,461,726, dated Dec. 11, 2013, 3 pages.

Canadian Office Action for Canadian Application No. 2,461,726, dated Jul. 19, 2010, 3 pages.

CasinoTrac TableTrac Services. Product Information Dalasheet [online]. CasinoTrac, 2015. Retrieved on Oct. 12, 2016 from the Internet: <URL: http://www.tabletrac.com/?pageid=15#prettyPhoto> (3 pages).

Chinese Office Action and Search Report from Chinese Application No. 201310361850.X, dated Oct. 10, 2018, 9 pages.

Christos Stergiou and Dimitrios Siganos, "Neural Networks," http://www.doc.ic.ac.uk~nd/surprise_96/journal/vol4/cs11/report.html (13 pages), Dec. 15, 2011.

Documents submitted in case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 15 of 23 (Binder 8, 3 of 5).

Documents submitted in case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 16 of 23 (Binder 8, 4 of 5).

Documents submitted in case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 17 of 23 (Binder 8, 5 of 5).

Documents submitted in the case of *Shuffle Master, Inc.* v. *Card Aurstia, et al.*, Case No. CV-N-0508-HDM-(VPC) (Consolidated with Case No. CV-N-02-0244-ERC-(RAM)), May 6, 2003, Part 13 of 23 (Binder 8, 1 of 5).

Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 1 of 23 (Master Index and Binder 1, 1 of 2).

Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 10 of 23 (Binder 6, 2 of 2).

Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 11 of 23 (Binder 7, 1 of 2).

Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 12 of 23 (Binder 7, 2 of 2).

Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 14 of 23 (Binder 8, 2 of 5).

Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 3 of 23 (Binder 2, 1 of 2).

Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 4 of 23 (Binder 2, 2 of 2).

Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 5 of 23 (Binder 3, 1 of 2).

DVD labeled Exhibit 1. This is a DVD taken by Shuffle Master personnel of the live operation of a CARD One2Six™ Shuffler (Oct. 7, 2003).

DVD labeled Luciano Decl. Ex. K is (see Binder 2-1, p. 215/237, Luciano Decl., para.14): A video demonstration (11minutes) of a Luciano Packaging prototype shuffler.

DVD labeled Solberg Decl.Ex.C, which is not a video at all, is (see Binder 4-1, p. 34/206, Solberg Deck, para.8): Computer source code for operating a computer-controlled card shuffler (an early Roblejo prototype card shuffler) and Descriptive comments of how the code works.

Error Back propagation, http://willamette.edu~gorr/classes/cs449/backprop.html(4 pages), Nov. 13, 2008.

European Examination Report for European Application No. 02780410, dated Aug. 9, 2011, 4 pages.

European Extended Search Report and Written Opinion from European Application No. 18195983.4, dated Jan. 29, 2019, 10 pages.

European Patent Application Search Report—European Patent Application No. 06772987.1, Dec. 10, 2009, 5 pages.

Fine, Randall A., "Talking Tables", dated Apr. 25, 2012. Global Gaming Business Magazine, vol. 11, No. 5, May 2012. Retrieved on Oct. 3, 2016 from the Internet: <URL: https://ggbmagazine.com/issue/vol-11-no-5-may-2012/article/talking-ables> (4 pages).

Genevieve Orr, CS-449: Neural Networks Willamette University, http://www.willamette.edu/-gorr/classes/cs449/intro.html (4 pages), Fall 1999.

Gola, Steve; Deposition; *Shuffle Tech International* v. *Scientific Games Corp., et al.* 1:15-cv-3702 (N.D. III.); Oct. 13, 2016; pp. 1, 9-21, 30-69, 150-167, 186-188, 228-231, 290-315,411; Henderson Legal Services, Inc.; Washington, DC.

Gros, Roger; New Card Management System to Be Tested at Baily's Park Place; Casino Journal; Apr. 1989; 5 pages.

(56) References Cited

OTHER PUBLICATIONS http://www.google.com/search?tbm=pts&q=Card+handling+device+with+input+and- +outpu . . . , Jun. 8, 2012.
http://www.google.com/search?tbm=pts&q=shuffling+zone+onOopposite+site+of+input+ . . . Jul. 18, 2012.
Lilwiller, Dave, CCD vs. CMOS: Facts and Fiction reprinted from Jan. 2001 Issue of Photonics Spectra, Laurin Publishing Co. Inc. (4 pages).
Malaysian Patent Application Substantive Examination Adverse Report—Malaysian Patent Application Serial No. PI 20062710, May 9, 2009, 4 pages.
Olsen, Eddie; Automatic Shuffler ready for Atlantic City experiment; Blackjack Confidential; Jul./Aug. 1989; pp. 5-7.
PCT International Preliminary Examination Report for International Patent Application No. PCT/US02/31105 dated Jul. 28, 2004, 9 pages.
PCT International Search Report and Written Opinion for International Application No. PCT/US2007/023168, dated Sep. 12, 2008, 8 pages.
PCT International Search Report and Written Opinion for PCT/US07/15035, dated Sep. 29, 2008, 6 pages.
PCT International Search Report and Written Opinion for PCT/US07/15036, dated Sep. 23, 2008, 6 pages.
PCT International Search Report and Written Opinion of the International Searching Authority for PCT/GB2011/051978, dated Jan. 17, 2012, 11 pages.
PCT International Search Report and Written Opinion of the International Searching Authority for PCT/IB2013/001756, dated Jan. 10, 2014, 7 pages.
PCT International Search Report and Written Opinion of the International Searching Authority for PCT/US05/31400, dated Sep. 25, 2007, 12 pages.
PCT International Search Report and Written Opinion of the International Searching Authority for PCT/US11/59797, dated Mar. 27, 2012, 14 pages.
PCT International Search Report and Written Opinion of the International Searching Authority for PCT/US13/59665, dated Apr. 25, 2014, 21 pages.
PCT International Search Report and Written Opinion of the International Searching Authority for PCT/US2008/007069, dated Sep. 8, 2008, 10 pages.
PCT International Search Report and Written Opinion, PCT Application No. PCT/US2015/022158, dated Jun. 17, 2015,13 pages.
PCT International Search Report and Written Opinion, PCT Application No. PCT/US2015/025420, dated Oct. 2, 2015, 15 pages.
PCT International Search Report and Written Opinion, PCT Application No. PCT/US2015/040196, dated Jan. 15, 2016, 20 pages.
PCT International Search Report and Written Opinion, PCT Application No. PCT/US2015/051038, dated Jan. 22, 2016, 11 pages.
PCT International Search Report and Written Opinion, PCT/US2012/48706, dated Oct. 16, 2012, 12 pages.
PCT International Search Report for PCT/US2005/034737 dated Apr. 7, 2006, 1 page.
PCT International Search Report for PCT/US2007/022894, dated Jun. 11, 2008, 3 pages.
Playtech Retail begins roll out of Neon across Grosveno.quadrature. 55 UK Casinos. Playtech. Apr. 21, 2016. Retrieved on Oct. 11, 2016 from the Internet: <URL: https://www.playtech.com/news/latest.sub.--news.sub.--and.sub.--prs/playt-ech.sub.--retail.sub.--begins.sub.--roll.sub.--out.sub.--of.sub.--neon.sub-.--across.sub.--grosvenor.sub.--s.sub.--55.sub..--uk.sub.--casinos> (1 page).
Prototype Glossary and Timelines; *Shuffle Tech International* v. *Scientific Games Corp., et al.* 1:15-cv-3702 (N.D. III.); undated; pp. 1-4.
Scarne's Encyclopedia of Games by John Scarne, 1973, "Super Contract Bridge", p. 153.
Shuffle Master Gaming, Service Manual, Let It Ride Bonus (Register) With Universal Keypad, 112 pages, (Copyright) 2000 Shuffle Master, Inc.
Shuffle Master's Reply Memorandum in Support of Shuffle Master's Motion for Preliminary Injunction for *Shuffle Master, Inc.* vs. *VendingData Corporation*, in the U.S. District Court, District of Nevada, No. CV-S-04-1373-JCM-LRL, Nov. 29, 2004.
Shuffle Master, Inc. (1996) Let It Ride, The Tournament, User Guide, 72 pages.
*Shuffle Tech International LLC et al.* vs. *Scientific Games Corporation et al.*, Order Denying Motion for Summary Judgement: Memorandum Opinion and Order, in the U.S. District Court, for the Northern District of Illinois Eastern Division, No. 15 C 3702, Sep. 1, 2017, 35 pages.
Solberg, Halyard; Deposition; *Shuffle Tech international* v. *Scientific Games Corp., et al.* 1:15-cv-3702 (N.D. III.); Oct. 18, 2016; pp. 187, 224-246, 326-330, 338-339, 396; Baytowne Reporting; Panama City, FL.
Statement of Relevance of Cited References, Submitted as Part of a Third-Party Submission Under 37 CFR 1.290 on Dec. 7, 2012 (12 pages).
TableScanner "Player Tracking". Product Information Datasheets [online]. Advansys, 2013. Retrieved on Sep. 23, 2016 from the Internet: <URL: http://advansys.si/products/tablescanner/player-tracking/> (4 pages).
tbm=pts&hl=en Google Serach for card handling device with storage area, card removing system pivoting arm and processor: http://www.google.com/?tbm=pts&hl=en; Jul. 28, 2012, 2 pages.
United States Court of Appeals for the Federal Circuit Decision Decided Dec. 27, 2005 for Preliminary Injuction for *Shuffle Master, Inc.* vs. *VendingData Corporation*, in the U.S. District Court, District of Nevada, No. CV-S-04-1373-JCM-LRL.
VendingData Corporation's Responses to Shuffle Master, Inc.'s First set of Interrogatories for *Shuffler Master, Inc.* vs. *VendingData Corporation*, in the U.S. District Court, District of Nevada, No. CV-S-04-1373-JCM-LRL, Mar. 14, 2005.
Weisenfeld, Bernie; Inventor betting on shuffler; Courier-Post; Sep. 11, 1990; 1 page.

* cited by examiner

CARD HANDLING DEVICES INCLUDING MULTI-CARD STORAGE COMPARTMENTS, AND RELATED METHODS

CROSS-REFERENCE TO RELATED APPLICATIONS

This application is a continuation of U.S. patent application Ser. No. 14/575,768, filed Dec. 18, 2014, now U.S. Pat. No. 10,668,361 issued Jun. 2, 2020, and which is a continuation of U.S. patent application Ser. No. 13/560,792, filed Jul. 27, 2012, now U.S. Pat. No. 8,960,674, issued Feb. 24, 2015, the disclosure of each of which is incorporated herein in its entirety by this reference.

The subject matter of this application is also related to the subject matter of U.S. patent application Ser. No. 16/173,687, filed Oct. 29, 2018, now U.S. Pat. No. 10,668,364, issued Jun. 2, 2020, and which is a continuation of U.S. patent application Ser. No. 15/363,374, filed Nov. 29, 2016, now U.S. Pat. No. 10,242,241, issued Nov. 13, 2018, which is a continuation of U.S. patent application Ser. No. 14/575,689, filed Dec. 18, 2014, now U.S. Pat. No. 9,849,368, issued Dec. 26, 2017, which is also a continuation application of U.S. patent application Ser. No. 13/560,792, filed Jul. 27, 2012, now U.S. Pat. No. 8,960,674, issued Feb. 24, 2015, the disclosure of each of which is incorporated herein in its entirety by this reference.

TECHNICAL FIELD

The present disclosure relates to automatic card shufflers for use in randomizing an order of a group of cards, such as standard playing cards, to methods of manufacturing such automatic card shufflers, and to methods of randomizing an order of a group of cards using such automatic card shufflers.

BACKGROUND

Card shufflers are used to randomize an order of cards in a stack of cards, and are frequently used in the gaming industry for use with playing cards, such as decks of standard playing cards which include four suits (i.e., clubs, diamond, hearts, and spades) of cards, wherein each suit includes a group of thirteen (13) differently ranked cards sequentially numbered from two (2) through ten (10), as well as a Jack, a Queen, a King, and an Ace. Such a standard deck of playing cards may also include one or more additional cards, such as two additional Jokers. Thus, a complete deck may comprise, for example, fifty-two (52) or fifty-four (54) playing cards.

Card shufflers are known in the art that, in addition to shuffling cards, may be used to sort cards into a predetermined order, such as what is referred to in the art as "new deck" order. To accomplish such a sorting operation, a card shuffler must be capable of accurately identifying indicia on each card, such as the rank and suit of standard playing cards. Card shufflers capable of sorting cards often include a card imaging system, which may include a camera that acquires an image of each card. An algorithm may be used to analyze the image and compare the image to images of cards of known identity. By determining to which known image the acquired image most closely corresponds, the identity of each card may be determined and used by the card shuffler to sort cards into a predetermined order.

Many previously known card shufflers are not capable of truly randomizing an order of the cards in any given set of cards due to limitations in the mechanism or system used to shuffle the cards. Thus, there remains a need in the art for card shufflers that are capable of truly randomizing an order of cards in a set of cards to a sufficient degree to be considered random in the shuffler arts. Additionally, it may be desirable to shuffle and/or sort cards using a card shuffler quickly so as to increase the amount of shuffling and/or sorting operations that may be performed by a card shuffler in any given amount of time.

The ACE® card shuffler, offered by Shuffle Master, Inc. of Las Vegas, Nev. in the past, and as described in U.S. Pat. No. 6,149,154, is a batch-type card shuffler with a vertically moving rack comprising multiple compartments. This structure lacks card recognition. Shuffling is accomplished through random loading of the racks. Packs of cards are formed in compartments. The order in which the cards are delivered to hand-forming compartments is substantially random. However, the composition of the pack is random. Cards placed in the discard rack are not randomly ordered. More than two cards are delivered to each compartment.

U.S. Pat. No. 6,267,248 describes a carousel-type card shuffler that uses a card imaging system to identify cards as they move from a card infeed tray to compartments in a rotatable carousel. The card shuffler randomly loads compartments in the carousel, and sequentially unloads the compartments. More than two cards may be delivered to each compartment. U.S. Pat. No. 6,651,981 describes a flush-mounted batch card shuffler that elevates shuffled cards to the game play surface. U.S. Pat. No. 7,677,565 describes a similar card shuffler that also includes card recognition capability. These card shufflers form a single stack of a shuffled deck or multiple decks. The stack formed in the shuffler is gripped at randomly selected elevations. A section of the stack of cards beneath the grippers is lowered, which creates an insertion opening into the stack into which additional cards may be inserted to shuffle the cards. Products as described in these patents have been commercialized by Shuffle Master, Inc. as DECK MATE® and MD2® and MD3™ card shufflers.

U.S. Pat. No. 7,766,332 describes a hand-forming card shuffler that includes card recognition capability. The device described in this patent has been commercialized by Shuffle Master, Inc. as the I-DEAL® card shuffler.

BRIEF SUMMARY

In some embodiments, the present disclosure includes an automatic card shuffler having a card input mechanism for inputting cards into the card shuffler, a card storage device for receiving cards from the card input mechanism and temporarily storing cards within the card shuffler, and a card output mechanism for outputting shuffled cards from the card shuffler. The card storage device includes a movable rack configured to move vertically within the card shuffler. The rack has a plurality of card storage compartments therein, each of which is sized and configured to hold two or more cards therein. In one embodiment, each compartment or most compartments receive no more than two cards. The card output mechanism further includes a movable ejector configured to simultaneously eject cards out from two or more card storage compartments of the movable rack.

In additional embodiments, the present disclosure includes an automatic card shuffler having a card input mechanism for inputting cards into the card shuffler, a card storage device for receiving cards from the card input mechanism and temporarily storing cards within the card shuffler, and a card output mechanism for receiving a stack of shuffled cards from the card storage device and outputting the stack of shuffled cards from the card shuffler. The card storage device includes a movable rack configured to move within the card shuffler. The rack has a plurality of card storage compartments, each of which is sized and configured to hold two cards therein and to prevent insertion of more than two cards therein. The card output mechanism includes a movable ejector configured to simultaneously eject cards out from two or more card storage compartments of the movable rack. In one embodiment, all cards in the rack are simultaneously ejected.

In additional embodiments, the present disclosure includes an automatic card shuffler having a card input mechanism for inputting cards into the card shuffler, a card storage device for receiving cards from the card input mechanism and temporarily storing cards within the card shuffler, and a card output mechanism for receiving shuffled cards from the card storage device and outputting the shuffled cards from the card shuffler. The card shuffler further includes a control system configured to receive input from a user of the automatic card shuffler, to output information to a user of the automatic card shuffler, and to control operation of components of the card input mechanism, the card storage device, and the card output mechanism. The control system includes a first control panel and a second control panel. The first control panel is located within the automatic card shuffler such that the first control panel is inaccessible to a user of the automatic card shuffler from outside the automatic card shuffler, while the second control panel is located at least partially outside the automatic card shuffler such that the second control panel is accessible to a user of the automatic card shuffler from outside the automatic card shuffler.

In additional embodiments, the present disclosure includes an automatic card shuffler having a card input mechanism for inputting cards into the card shuffler, a card storage device for receiving cards from the card input mechanism and temporarily storing cards within the card shuffler, and a card output mechanism for receiving a stack of shuffled cards from the card storage device and outputting the stack of shuffled cards from the card shuffler. The card storage device includes a movable rack configured to move within the card shuffler. The rack has a plurality of card storage compartments, each of which is sized and configured to hold two or more cards therein. The card output mechanism includes a movable ejector configured to simultaneously eject cards out from two or more card storage compartments of the movable rack. The movable ejector is capable of simultaneously ejecting cards out from less than all card storage compartments of the movable rack.

In additional embodiments, the present disclosure includes an automatic card shuffler including a card input mechanism for inputting cards into the card shuffler, a card storage device for receiving cards from the card input mechanism and temporarily storing cards within the card shuffler, and a card output mechanism for receiving a stack of shuffled cards from the card storage device and outputting the stack of shuffled cards from the card shuffler. The card storage device includes a movable rack configured to move within the card shuffler. The rack has a plurality of card storage compartments, each of which is sized and configured to hold two or more cards therein. The card output mechanism includes a movable ejector configured to simultaneously eject cards out from two or more card storage compartments of the movable rack. The movable ejector is disposed on a first side of the movable rack as cards are inserted into the movable rack by the card input mechanism, and the ejector moves from the first side of the movable rack to an opposing second side of the rack and back to the first side of the rack to eject cards out from the two or more card storage compartments of the movable rack.

In additional embodiments, the present disclosure includes an automatic card shuffler comprising a card input mechanism for inputting cards into the card shuffler, a card storage device for receiving cards from the card input mechanism and temporarily storing cards within the card shuffler, the card storage device including a plurality of card storage compartments, and a card output mechanism for receiving shuffled cards from the card storage device and outputting the stack of shuffled cards from the card shuffler. The card input mechanism includes a card support for supporting a stack of cards thereon, at least one pick-off roller configured to move a bottommost card in a stack of cards supported on the card support toward the card storage device, and an adjustable brake roller assembly. The brake roller assembly includes a bracket and a brake roller coupled to the bracket and configured to move relative to the bracket to selectively adjust a card gap between the brake roller and the at least one pick-off roller.

In additional embodiments, the present disclosure includes an automatic card shuffler comprising a card input mechanism for inputting cards into the card shuffler, a card storage device for receiving cards from the card input mechanism and temporarily storing cards within the card shuffler, and a card output mechanism for receiving a stack of shuffled cards from the card storage device and outputting the stack of shuffled cards from the card shuffler. The card storage device includes a movable rack configured to move within the card shuffler. The rack has a plurality of card storage compartments therein. The rack further includes a card size adjustment member capable of being positioned relative to the rack in a first orientation and a different second orientation. Each of the plurality of card storage compartments has a first size when the card size adjustment member is positioned relative to the rack in the first orientation, and has a different second size when the card size adjustment member is positioned relative to the rack in the second orientation.

In additional embodiments, the present disclosure includes a method of shuffling cards using an automatic card shuffler. Cards are input into an automatic card shuffler using a card input mechanism. Two or more cards are temporarily stored in each of a plurality of card storage compartments in a movable rack of a card storage device within the card shuffler. Cards are simultaneously ejected out from the plurality of card storage compartments using a movable ejector to form a stack of shuffled cards, and the stack of shuffled cards is output from the card shuffler using a card output mechanism of the card shuffler.

In additional embodiments, the present disclosure includes a method of shuffling cards using an automatic card handling machine. Cards are input into the automatic card handling machine using a card input mechanism. Two cards are temporarily stored in each of a plurality of card storage compartments in a movable rack of a card storage device within the automatic card handling machine without inserting more than two cards in each of the plurality of card storage compartments. Cards are ejected out from the plurality of card storage compartments using a movable ejector to form a stack of shuffled or sorted cards, and the stack of shuffled or sorted cards is output from the automatic card handling machine using a card output mechanism.

In additional embodiments, the present disclosure includes a method of fabricating an automatic card shuffler. A card input mechanism is formed that is carried by a frame, and the card input mechanism is configured to input cards into the card shuffler. A card storage device for receiving cards from the card input mechanism is mounted to the frame. A card output mechanism is formed that is carried by the frame, and the card output mechanism is configured to receive shuffled cards from the card storage device and to output the shuffled cards from the card shuffler. A control system is operatively coupled to active components of each of the card input mechanism, the card storage device, and the card output mechanism. The control system is configured to receive input from a user of the automatic card shuffler, to output information to a user of the automatic card shuffler, and to control operation of the active components of the card input mechanism, the card storage device, and the card output mechanism. The control system is provided with a first control panel and with a second control panel. The first control panel is located within the automatic card shuffler such that the first control panel is inaccessible to a user of the automatic card shuffler from outside the automatic card shuffler. The second control panel is located at least partially outside the automatic card shuffler such that the second control panel is accessible to a user of the automatic card shuffler from outside the automatic card shuffler.

In additional embodiments, the present disclosure includes methods of shuffling cards using an automatic card shuffler. Cards are input into an automatic card shuffler using a card input mechanism. Two or more cards are temporarily stored in each of a plurality of card storage compartments in a movable rack of a card storage device within the card shuffler. Cards are simultaneously ejected out from two or more of the plurality of card storage compartments using a movable ejector, without ejecting cards out from some of the plurality of card storage compartments, to form a stack of shuffled cards. The stack of shuffled cards is output from the card shuffler using the card output mechanism.

In additional embodiments, the present disclosure includes methods of shuffling cards using an automatic card shuffler. Cards are input into an automatic card shuffler using a card input mechanism. Two or more cards are temporarily stored in each of a plurality of card storage compartments in a movable rack of a card storage device within the card shuffler. Cards are simultaneously ejected out from the plurality of card storage compartments using a movable ejector to form a stack of shuffled cards, and the stack of shuffled cards is output from the card shuffler using a card output mechanism. The movable ejector is maintained on a first side of the movable rack as cards are inserted into the movable rack by the card input mechanism. The movable ejector is moved from the first side of the movable rack to an opposing second side of the rack and back to the first side of the rack to simultaneously eject cards out from the plurality of card storage compartments to form the stack of shuffled cards.

In additional embodiments, the present disclosure includes a method of adapting an automatic card shuffler for use with cards of different thicknesses. The method includes driving movement of a card through a card gap between at least one pick-off roller and a brake roller of an adjustable brake roller assembly, and moving the brake roller relative to a bracket of the adjustable brake roller assembly to selectively adjust the card gap between the brake roller and the at least one pick-off roller.

In additional embodiments, the present disclosure includes a method of adapting an automatic card shuffler for use with cards of different size. Cards having a first card size are temporarily stored in a plurality of card storage compartments in a movable rack of the automatic card shuffler while a card size adjustment member is positioned relative to the movable rack in a first orientation. Each of the card storage compartments has a first size when the card size adjustment member is positioned relative to the movable rack in the first orientation. The card size adjustment member is moved relative to the movable rack to a different second orientation. Each of the card storage compartments has a second size when the card size adjustment member is positioned relative to the movable rack in the second orientation. Cards having a different second card size are temporarily stored in the plurality of card storage compartments in the movable rack of the automatic card shuffler while the card size adjustment member is positioned relative to the movable rack in the second orientation.

DETAILED DESCRIPTION

The illustrations presented herein are not meant to be actual views of any particular card shuffler or component thereof, but are merely idealized representations that are used to describe embodiments of the disclosure.

As used herein, the term "shuffle," when used with reference to cards, means to randomize an order of cards in a stack of cards.

Figure 1:
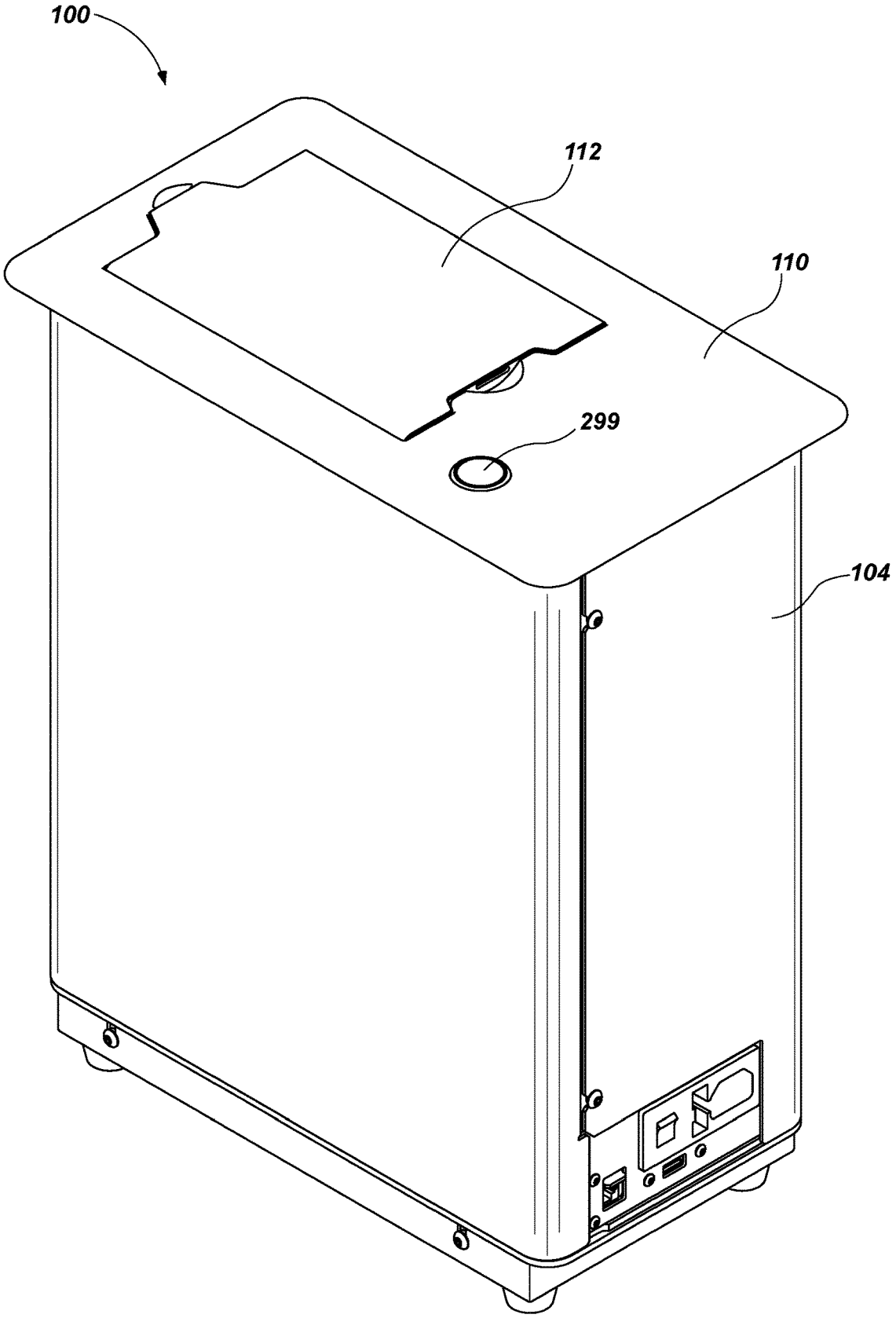
FIG. 1 is a back isometric view of an automatic card shuffler including a lid to cover a card input area and a card output area, wherein the lid is illustrated in a closed position.

FIG. 1 is a perspective view of an automatic card shuffler 100. The card shuffler 100 is configured to automatically randomize an order of cards in a stack of cards. The cards may be playing cards for use in playing card games, such as poker, single deck blackjack or double deck blackjack, or other hand-pitched games. The card shuffler 100 is a batch card shuffler, in that a plurality of cards are inserted into the card shuffler 100 in the form of a first stack, the card shuffler 100 randomly reorders the cards and assembles the cards into a second shuffled stack, which is then output from the card shuffler 100 in batch form as a stack of shuffled cards.

The card shuffler 100 may be capable of performing additional operations on one or more cards inserted into the card shuffler 100. For example, the card shuffler 100 may be configured to sort cards in a stack of cards inserted into the card shuffler 100 into a predefined order. The card shuffler 100 may be configured to verify the presence or absence of cards in a predefined set of different cards having one or more distinguishing characteristics (e.g., rank and/or suit of standard playing cards and/or special card markings). The card shuffler 100 may be configured to detect and identify cards that are damaged to allow the cards to be removed from a set of cards prior to use of the set of cards in a playing card game. Thus, although the card handling machine is referred to herein as a card "shuffler," it may also be characterized as a card sorter, a card verifier, etc.

As discussed in further detail below, the card shuffler 100 includes an internal card storage device, a card input mechanism for moving cards from a card input area into the internal card storage device, and a card output mechanism for moving cards from the internal card storage device to a card output area. The card shuffler 100 also may include a card reading system for capturing data from one or more images of cards inserted into the card shuffler 100. Examples of suitable card reading systems include complementary metal-oxide-semiconductor (CMOS) 2D imaging systems and contact image sensor (CIS) and CMOS line scanners. The card shuffler 100 further includes a control system for controlling the various active components of the card shuffler 100, for receiving input from a user of the card shuffler 100, and for outputting information to a user of the card shuffler 100.

Figure 2:
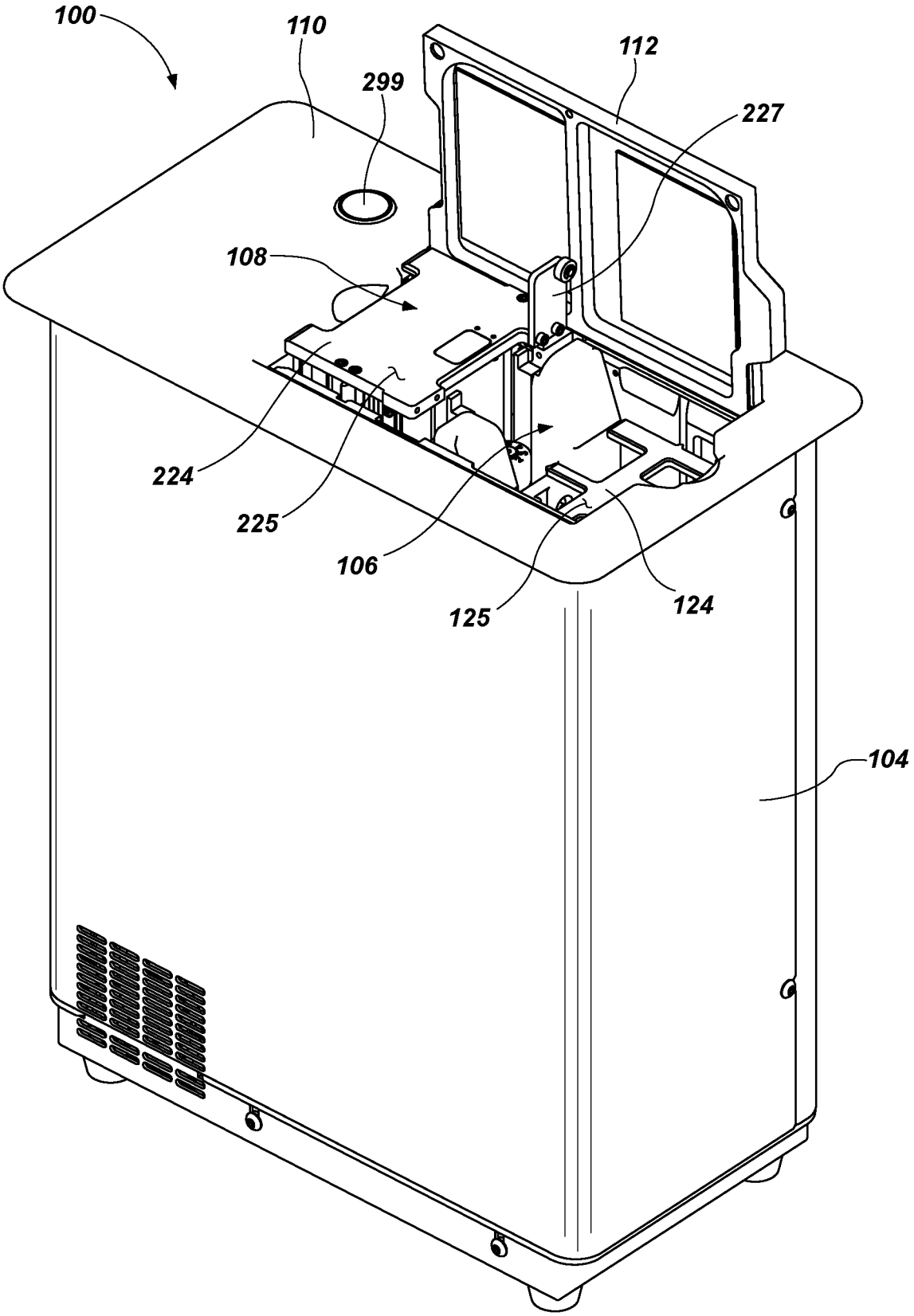
FIG. 2 is a front isometric view of the card shuffler of FIG. 1 illustrating the lid in an open position exposing the card input area and the card output area.
Figure 4:
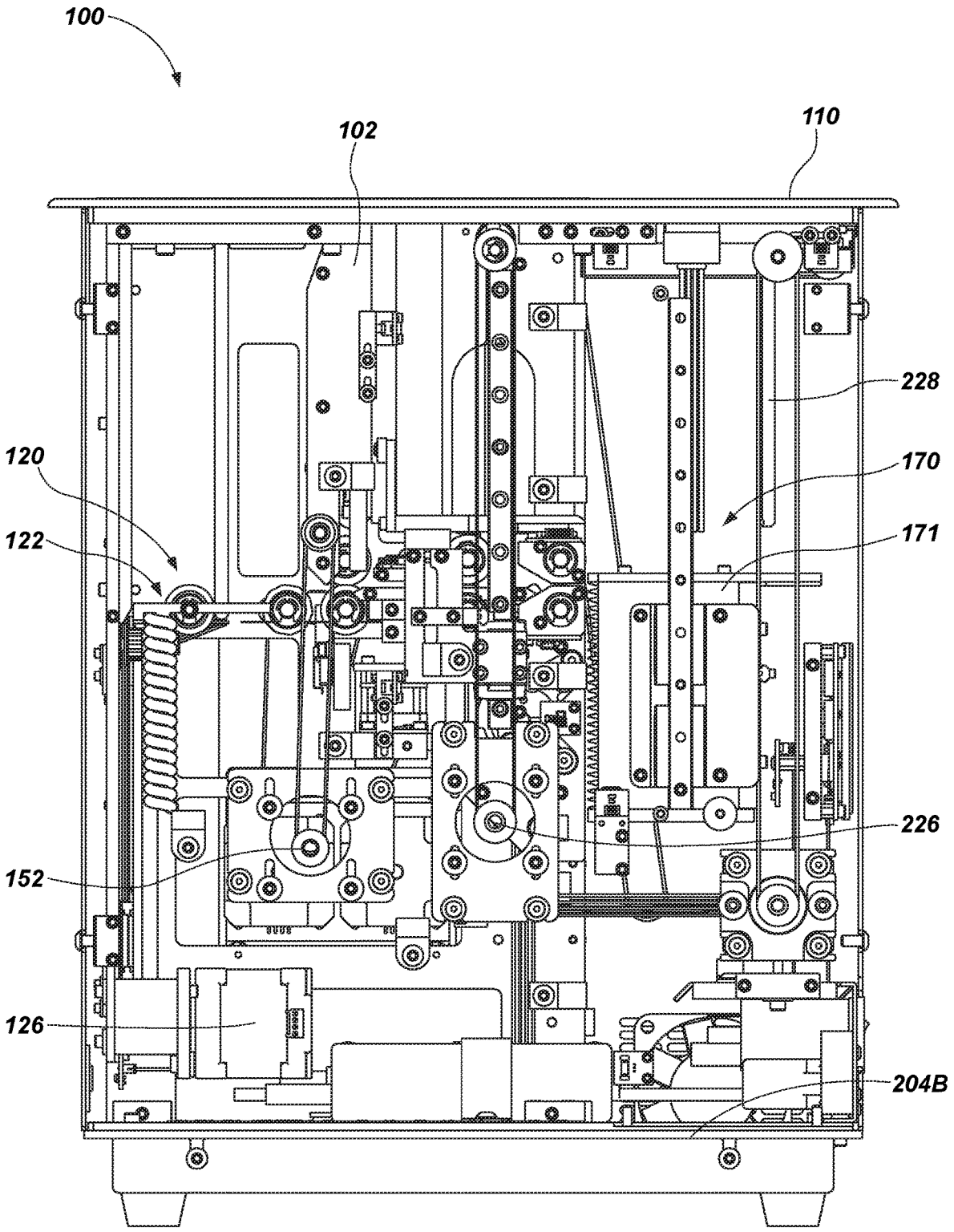
FIG. 4 is a second side elevational view of a right side of the card shuffler with the outer cover removed.
Figure 5:
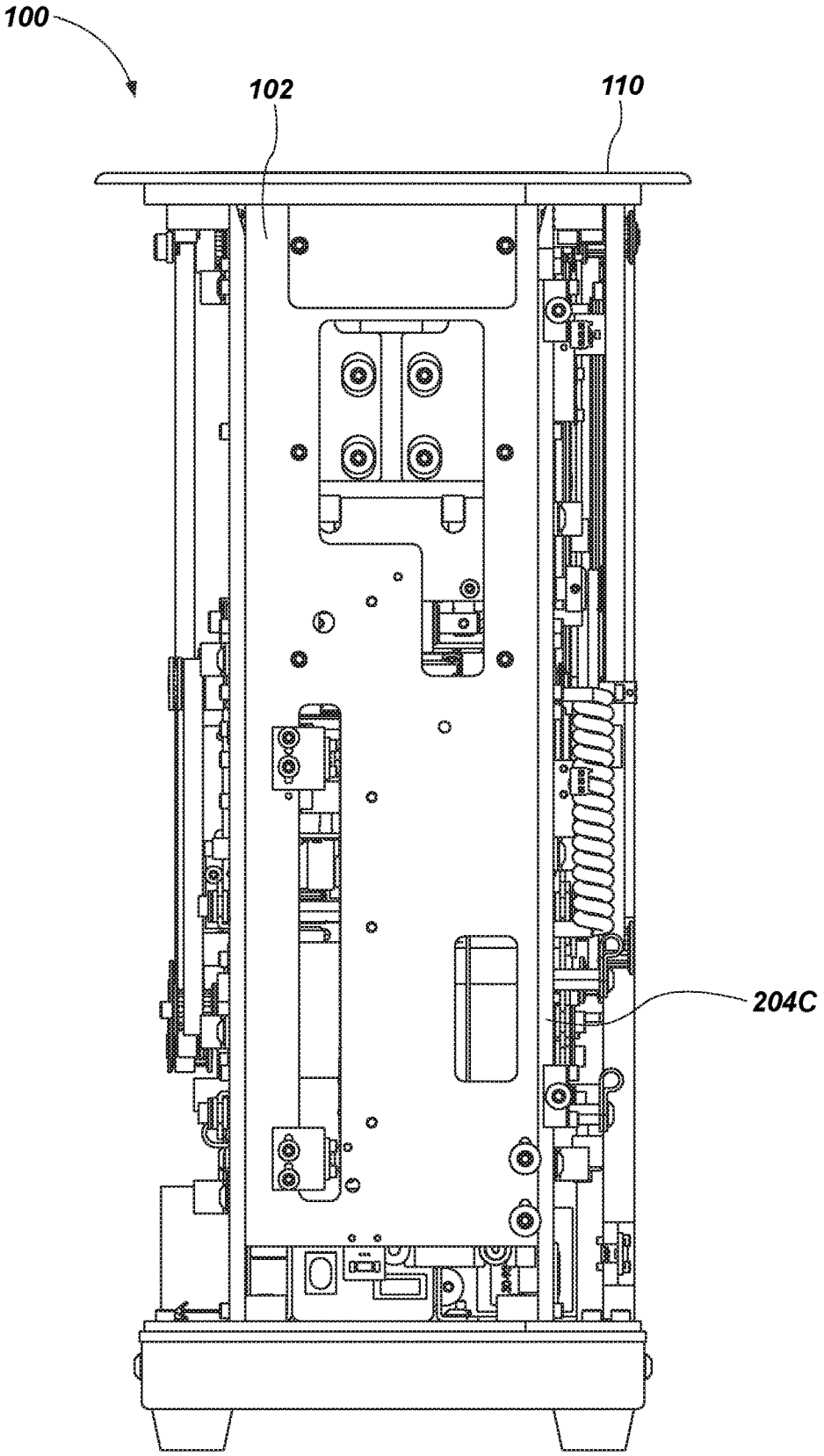
FIG. 5 is a third side elevational view of a front side of the card shuffler with the outer cover removed.

Referring briefly to FIG. 4, the card shuffler 100 includes an internal structural frame 102, to which the various components of the card shuffler 100 may be directly or indirectly coupled. The frame 102 may comprise a plurality of members that may be coupled together to form the frame 102. Referring again to FIG. 1, an outer cover 104 may be coupled to the internal structural frame 102 around the internal components of the card shuffler 100. The outer cover 104 covers and protects the internal components of the card shuffler 100. The card shuffler 100 includes a card input area 106 and a separate card output area 108, as shown in FIG. 2. Cards to be shuffled may be assembled into a first stack, which may be placed into the card input area 106. After shuffling or sorting the cards, the card shuffler 100 may deliver a second stack to the card output area 108. As mentioned above, the second stack may be formed by randomly reordering the cards in the first stack placed in the card input area 106.

The card shuffler 100 may be configured to be mounted such that an upper surface 110 of the card shuffler 100 is at least substantially level (i.e., flush) with a surface of a playing card table, such as a poker table for example. A lid 112 may be used to cover the card input area 106 and the card output area 108 at times other than when cards are being loaded into the card input area 106 or being removed from the card output area 108. The lid 112 may be attached to the frame 102 and/or the upper surface 110 of the outer cover 104 (FIG. 4) and may be configured to open and close automatically during operation of the card shuffler 100. FIG. 1 illustrates the card shuffler 100 with the lid 112 in the closed position, and FIG. 2 illustrates the card shuffler 100 while the lid 112 is in the open position for loading and/or unloading cards.

Figure 3:
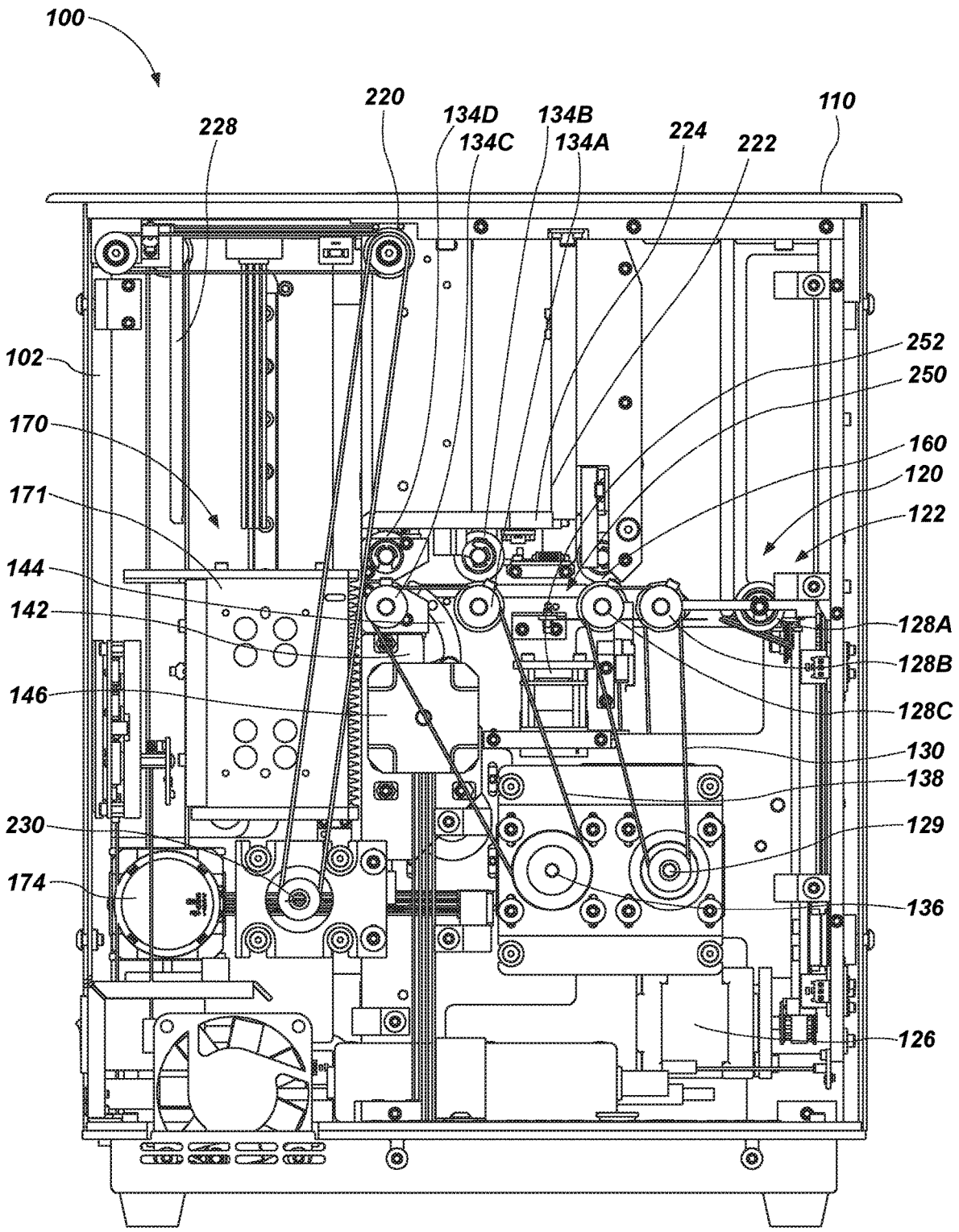
FIG. 3 is a first side elevational view of a left side of the card shuffler with an outer cover removed to expose internal components of the card shuffler.

FIGS. 3 through 6 illustrate the card shuffler 100 with the outer cover 104 and other components, such as frame members, removed from the view to reveal internal components and mechanisms of the card shuffler 100. As shown in FIG. 3, the card shuffler 100 includes a card input mechanism 120, a card storage device 170 for temporarily storing cards within the card shuffler 100, and a card output mechanism 220. The card input mechanism 120 is configured to move cards from the card input area 106 (FIG. 2) into the card storage device 170, and the card output mechanism 220 is configured to move cards from the card storage device 170 to the card output area 108 (FIG. 2).

The card input mechanism 120 includes an input elevator 122 including a card support 124 (FIG. 2) that is configured to translate vertically along a linear path between an upper loading position and a lower unloading position, and a motor 126 configured to drive movement of the card support 124 between the loading and unloading positions. As shown in FIG. 2, the card support 124 has an upper support surface 125 for supporting a stack of cards thereon. In the loading position, the card support 124 is located proximate the upper surface 110 of the card shuffler 100 to allow a user to place a stack of cards to be shuffled on the support surface 125 of the card support 124 in the card input area 106. This position may be above, below or at the gaming surface elevation. In the unloading position, the card support 124 is located at another position within the card shuffler 100 from which cards are moved out from the stack and toward the card storage device 170.

Referring again to FIGS. 3 through 6, the card input mechanism 120 includes one or more pick-off rollers 128A-128C. The pick-off rollers 128A-128C are used to sequentially move a bottom card in a stack of cards on the support surface 125 out from the stack of cards in a lateral, horizontal direction toward the card storage device 170. Two or more of the pick-off rollers 128A-128C may be driven in unison by a motor 129 using a belt 130 engaged with complementary pulleys mounted on axles carrying the pick-off rollers 128A-128C. One or more of the pick-off rollers 128A-128C, such as the pick-off roller 128A, optionally may comprise an idler roller that is not driven by the motor 129, but rather idly rolls along the surface of a card moving past the idler roller responsive to rotation of other driven pick-off rollers, such as 128B and 128C, driven by the motor 129.

As discussed in further detail below with reference to FIGS. 11 and 12, the card input mechanism 120 may further include an adjustable brake roller assembly 156 that includes a brake roller 160 disposed proximate the pick-off roller 128C so as to dispose a card gap between the brake roller 160 and the pick-off roller 128C through which cards pass as they move through the card input mechanism 120 toward the card storage device 170.

With continued reference to FIGS. 3 through 6, the card input mechanism 120 further includes one or more speed-up rollers 134A-134D, and a motor 136 configured to drive rotation of one or more of the speed-up rollers 134A-134D. The speed-up rollers 134A-134D are used to accept a card from the pick-off rollers 128A-128C, and to insert the card into the card storage device 170. The speed-up rollers 134A-134D may be located and configured to contact and grab a leading edge of a card just prior to the point at which a trailing edge of the card passes beyond and is released from the pick-off rollers 128A-128C. Thus, as the leading edge of the card contacts the speed-up rollers 134A-134D, as controlled and determined by selective rotation of the pick-off rollers 128A-128C, the card will be grabbed and pulled out from the pick-off rollers 128A-128C and inserted into the card storage device 170 by the speed-up rollers 134A-134D.

As with the pick-off rollers 128A-128C, two or more of the speed-up rollers 134A-134D may be driven in unison by the motor 136 using a belt 138 engaged with complementary pulleys mounted on axles carrying the speed-up rollers 134A-134D. One or more of the speed-up rollers 134A-134D, such as the speed-up roller 134B and the speed-up roller 134D, optionally may comprise idler rollers that are not driven by the motor 136, but rather idly roll along the surface of a card moving past the idler roller responsive to rotation of other driven speed-up rollers, such as 134A and 134C, driven by the motor 136.

During a shuffling operation of the card shuffler 100, the speed-up rollers 134A-134D may be continuously rotated at a substantially constant rotational speed. Rotation of the pick-off rollers 128A-128C, however, may be selectively started and stopped by a control system 280 (FIG. 13) of the card shuffler 100. When rotation of the pick-off rollers 128A-128C is commenced, the pick-off rollers 128A-128C may rotate at a rotational speed that is less than the rotational speed of the speed-up rollers 134A-134D.

The card input mechanism 120 further includes a packing device 142 that is used to ensure that cards inserted into the card storage device 170 are fully inserted into the card storage device 170. The packing device 142 includes a card packer arm 144, and a motor 146 configured to drive movement of the card packer arm 144 between a first extended position (see FIG. 14D) and a second retracted position (see FIG. 14C). Referring briefly to FIG. 14C, the card packer arm 144 may be mounted on an axle 148, about which rotation of the card packer arm 144 may be driven by the motor 146. Referring again to FIGS. 3 through 6, the card packer arm 144 may be moved to the retracted position to allow a card to pass by the card packer arm 144 and into the card storage device 170. After the trailing edge of the moving card has passed over the card packer arm 144, the card packer 144 may be moved into the extended position, which may "pack" the card into the card storage device 170 in such a manner as to ensure that the card is pushed fully into the card storage device 170 and does not bounce back out from the card storage device 170. Thus, the card packer arm 144 of the packing device 142 may rock back and forth with each successive passing card, ensuring that each card is fully seated within the card storage device 170.

The card input mechanism 120 may further include a card weight device (not visible) for applying a downward force on any stack of cards resting on the card support 124. The force applied on the stack of cards may ensure that sufficient frictional force is provided between the bottommost card in the stack of cards on the card support 124 and the pick-off rollers 128A-128C to ensure that the pick-off rollers 128A-128C can reliably remove the bottommost cards sequentially one at a time from the stack until each card in the stack has been removed. The card weight device may comprise a lever that may be moved into an activated position in which the card weight device is in direct physical contact with the upper surface of the topmost card in the stack of cards on the card support 124, and applies a downward force to the cards, after the input elevator 122 has been lowered into the card shuffler 100 below the card input area 106. The lever also may be moved into a deactivated position in which the lever does not engage the stack of cards on the card support 124. A card weight motor 152 (see FIG. 13) may be used to drive movement of the card weight device between the activated position and the deactivated position. After all cards in the stack of cards on the card support 124 have been moved into the card storage device 170 by the card input mechanism 120, the card weight motor 152 may be actuated to retract the card weight device into the deactivated position so as to allow additional cards to be placed onto the card support 124.

Figure 8A:
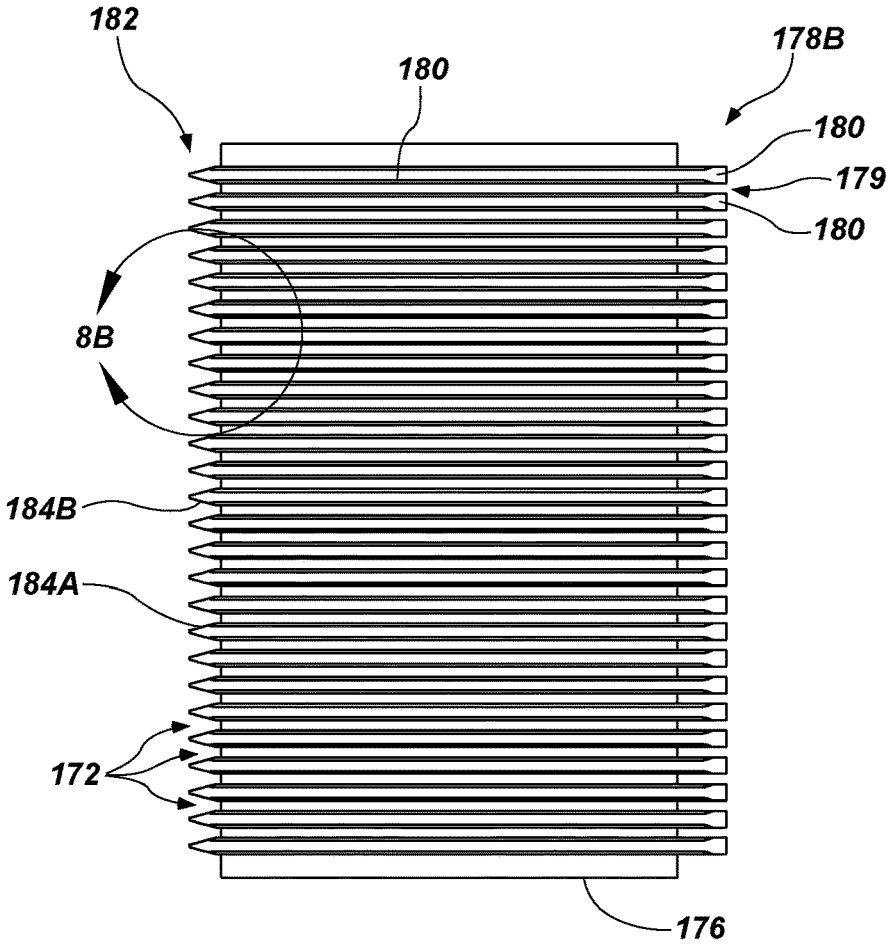
FIG. 8A is a side elevational view of a component of the rack.
Figure 8B:
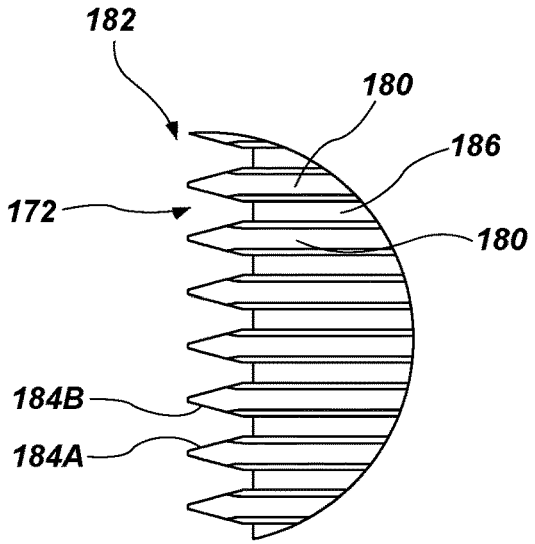
FIG. 8B is an enlarged view of a portion of FIG. 8A.

The card storage device 170 includes a rack 171 that includes a plurality of card storage compartments 172 therein (see FIGS. 8A and 8B). Each of the card storage compartments 172 may be sized and configured to contain one or more cards therein. In some embodiments, each of the card storage compartments 172 may be sized and configured to contain two or more cards therein. In some embodiments, each card storage compartment 172 may be sized and configured to hold only two cards therein. For example, each card storage compartment 172 may have a thickness of between about 0.0107 inch and about 0.0129 inch. In such embodiments, the number of card storage compartments 172 may be equal to one half of a number of cards that are expected to be shuffled using the card shuffler 100. For example, if the card shuffler 100 is configured to shuffle a single fifty-two (52) card deck of standard playing cards, which optionally may include two additional cards (e.g., Jokers), the rack 171 may include between twenty-six (26) and twenty-nine (29) card storage compartments 172. It may be desirable to provide one or two extra shelves so that the machine can deliver a card when a prior delivery attempt to a different compartment failed. For example, if a card is bent and cannot be inserted into a selected compartment, the card shuffler 100 may move the card into an extra compartment (which, in some embodiments, may be larger in size than other compartments to accommodate such a bent card). In embodiments for processing two decks of 52 to 54 cards each, the rack can contain between fifty-four (54) and fifty-eight (58) compartments.

The card rack 171 is configured to translate in the vertical direction along a linear path. The card storage device 170 includes a motor 174 configured to drive movement of the rack 171 up and down in the vertical direction. The motor 174 includes an encoder, which may be used to identify relative positions of the rack 171 from a known home position. The home position may correspond to the location at which a bottom surface 176 of the rack 171 (FIG. 8A) is aligned with a card disposed between the speed-up rollers 134A-134D.

To identify and calibrate the home position in a set-up or a calibration operational mode of the card shuffler 100, the rack 171 may be moved to the lowermost position within the card shuffler 100, and the encoder associated with the motor 174 may be reset, or the value of the encoder at the lowermost position may be recorded. The rack 171 may be moved upward within the card shuffler 100 to a location at which the bottom surface 176 of the rack 171 will certainly be located in a plane located vertically above any card gripped between the speed-up rollers 134A-134D. The card shuffler 100 then may cause the speed-up rollers 134A-134D to move a card into the space below the rack 171 without losing the grip on the card and completely inserting the card into the space below the rack 171. The card then may be drawn back away from the space below the rack 171 by the speed-up rollers 134A-134D, and the rack 171 may be lowered by a small incremental distance. The card shuffler 100 then may again cause the speed-up rollers 134A-134D to attempt to move the card into the space below the rack 171 without losing the grip on the card by the speed-up rollers 134A-134D. This process of attempting to insert the card into the space below the bottom surface 176 of the rack 171 and then incrementally lowering the rack 171 may be repeated until the card abuts against the side of the rack 171, such that the speed-up rollers 134A-134D are prevented from inserting the card into the space an expected distance, which may be detected by, for example, using a sensor (as discussed below) or monitoring an electrical current of the motor 136 driving the speed-up rollers 134A-134D. The location of the rack 171 at this point, as determined by the value of the encoder associated with the motor 174, may be set as the home position in the control system 280 (FIG. 13) of the card shuffler 100. In additional embodiments, the rack 171 may be moved to the lowermost position within the card shuffler 100, and the encoder associated with the motor 174 may be reset, or the value of the encoder at the lowermost position may be recorded. The rack 171 may be moved upward within the card shuffler 100 to a location at which the bottom surface 176 of the rack 171 will certainly be located in a plane located vertically below any card gripped between the speed-up rollers 134A-134D, but wherein all card storage compartments are located vertically above any card gripped between the speed-up rollers 134A-134D. The card shuffler 100 then may cause the speed-up rollers 134A-134D to attempt to move a card into the rack 171. If the card is not able to be inserted into the rack 171, the card then may be drawn back away from the rack 171 by the speed-up rollers 134A-134D, and the rack 171 may be raised by a small incremental distance. The card shuffler 100 then may again cause the speed-up rollers 134A-134D to attempt to move the card into the rack 171 or into a space below the rack 171 without losing the grip on the card by the speed-up rollers 134A-134D. This process of attempting to move the card into a space occupied by the rack 171 and then incrementally raising the rack 171 may be repeated until the card is able to move into the space below the rack 171 without losing the grip on the card by the speed-up rollers 134A-134D, which may be detected by, for example, using a sensor (as discussed below) or monitoring an electrical current of the motor 136 driving the speed-up rollers 134A-134D. The location of the rack 171 at this point, as determined by the value of the encoder associated with the motor 174, may be set as the home position in the control system 280 (FIG. 13) of the card shuffler 100.

FIGS. 7 through 10 illustrate the card storage device 170 separate from other components of the card shuffler 100. As shown therein, the rack 171 optionally may include a first side bracket assembly 178A and a second side bracket assembly 178B. Each of the side bracket assemblies 178A, 178B include multiple slots 179 formed therein so as to define ribs 180 between the slots 179. The side bracket assemblies 178A, 178B may be aligned with one another and coupled together using one or more cross members 188, such that a central void 189 is defined between the side bracket assemblies 178A, 178B, and such that slots 179 in the first side bracket assembly 178A align with corresponding complementary slots 179 in the second side bracket assembly 178B. Each card storage compartment 172 is defined by a slot 179 in the first side bracket assembly 178A and a corresponding and complementary slot 179 in the second side bracket assembly 178B.

The central void 189 between the side bracket assemblies 178A, 178B may be sized and configured to allow an ejector 228 (FIGS. 3 and 4) to be positioned within or adjacent the rack 171 alongside cards positioned within the card storage compartments 172, and to translate horizontally in a lateral direction to eject cards out from the rack 171, as discussed in further detail below. As shown in FIGS. 8A and 8B, ends 182 of the ribs 180 proximate the speed-up rollers 134A-134D may include tapered upper surfaces 184A and tapered lower surfaces 184B. Cards contacting the tapered surfaces are deflected and driven into the compartment 172 adjacent to a card already present in the compartment. By aligning the card being fed with an upper tapered surface, the card may be driven into the compartment 172 above a card already present. By aligning the card being fed with a lower tapered surface, the card may be driven into the compartment 172 below a card already present. When the device is used to place cards in a pre-selected order, such as original deck order, the tapered surfaces are essential to achieve a desired order. When a random order is desired, the tapered surfaces may also be used to achieve a desired random distribution. For example, the processor may select a location for each card to be fed at the beginning of a shuffling cycle. Each compartment has two locations, an upper and lower. If a card was assigned to location 1, another card would be driven in below the first card in location 2.

As discussed in further detail below, the card shuffler 100 may be configured to selectively position the rack 171 any one of three different positions for each of the card storage compartments 172 in the rack 171. In particular, the card shuffler 100 may be configured to selectively position the rack 171 such that a card being inserted into a selected card storage compartment 172 by the speed-up rollers 134A-134D is aligned with a space 186 between the upper rib 180 defining that card storage compartment 172 and the lower rib 180 defining that card storage compartment 172, such that the card is aligned with the tapered lower surface 184B of the upper rib 180 defining that card storage compartment 172, or such that the card is aligned with the tapered upper surface 184A of the lower rib 180 defining that card storage compartment 172, depending on whether or not a card is already present within the card storage compartment 172 and whether the card is to be positioned in an upper position or a lower position within that card storage compartment 172.

Referring again to FIGS. 3 through 6, the card shuffler 100 includes a card output mechanism 220 (FIG. 3) for moving cards within the rack 171 of the card storage device 170 out from the rack 171 and to the card output area 108 (FIG. 2). As shown in FIG. 3, the card output mechanism 220 includes an output elevator 222 including a card support 224 (see also FIG. 2) that is configured to translate vertically along a linear path between a lower loading position and an upper unloading position, and a motor 226 (FIG. 4) configured to drive movement of the card support 224 between the loading and unloading positions. The card support 224 has an upper card support surface 225 (FIG. 2) for supporting a stack of cards thereon. In the loading position, the card support 224 is located at a position within the card shuffler 100 at which all cards in the rack 171 may be moved out from the rack 171 and onto the support surface 225 of the card support 224. In the unloading position, the card support 224 is located proximate the upper shuffled cards from the support surface 225 of the card support 224, as shown in FIG. 2. The card support surface 225 may be located above, below or at the upper surface 110. As also shown in FIG. 2, a lever member 227 may be attached to the card support 224. The lever member 227 may be located and configured to impinge against and lift the lid 112 automatically as the card support 224 moves to the upper unloading position. As the card support 224 is lowered to the lower loading position, the lid 112 may automatically close due to the force of gravity, the force of member 227, one or more springs or other biasing members, etc.

As shown in FIGS. 3 and 4, the card output mechanism 220 includes an ejector 228 that is used to eject all cards within the card storage compartments 172 in the rack 171 out from the rack 171, simultaneously and together in batch form as a group, and onto the card support surface 225 of the card support 224 in the form of a stack of shuffled cards. The ejector 228 may comprise an elongated and vertically oriented bar or rod having a length at least as long as the height of the rack 171. The ejector 228 may be mounted to the frame 102 at a location in a plane vertically above the rack 171. The ejector 228 may be configured to translate horizontally along a linear path between a first position on a first lateral side of the rack 171 proximate the card support 224 and the speed-up rollers 134A-134D, and a second position on an opposite second lateral side of the rack 171 from the card support 224 and the speed-up rollers 134A-134D. The card output mechanism 220 further includes an ejector motor 230 (FIG. 3) configured to selectively drive movement of the ejector 228 between the first position and the second position.

As previously mentioned, the rack 171 includes a central void 189 defined between the side brackets 178A, 178B. The central void 189 and the ejector 228 may be sized and configured to allow the ejector 228 to move through the central void 189 from the second position of the ejector 228 (on the side of the rack 171 opposite the card support 224) to the first position of the ejector 228 (on the same side of the rack 171 as the card support 224) when the rack 171 is in the upper position, which will cause the ejector 228 to eject any and all cards in the card storage compartments 172 of the rack 171 to be simultaneously ejected out from the rack 171 and onto the card support surface 225 of the card support 224.

In additional embodiments, however, the rack 171 may not be positioned in the uppermost position when the ejector 228 is used to eject cards in the card storage compartments 172 out from the rack 171, and may be positioned at a selected location, such that cards are ejected from a selected number of card storage compartments 172 that is less than the total number of card storage compartments 172. In other words, the rack 171 may be positioned such that any card storage compartments 172 vertically above a horizontal plane in which the lowermost end of the ejector 228 is located will be ejected out from the rack 171 upon actuation of the ejector 228. In such a configuration, the ejector 228 of the card output mechanism 220 is configured to simultaneously eject cards out from two or more card storage compartments 172 of the movable rack 171, and is capable of simultaneously ejecting cards out from less than all card storage compartments 172 of the movable rack 171.

The card shuffler 100 optionally may include a card reading and/or imaging system 250 configured to capture data representing at least rank and suit information included in one or more images of each card passing through the card shuffler 100, so as to allow the card shuffler 100 to identify one or more characteristics of the cards, such as the rank and/or suit of standard playing cards. In some embodiments, however, data pertaining to cards read using the card reading system 250 may not be used in the shuffling operations performed by the card shuffler 100 for the purpose of determining the random card order, although the data may be used in the shuffling operations for the purpose of card verification. The data pertaining to card data read using the card reading system 250 may be used to verify the completeness of a set of cards by ensuring that no card expected to be in the set of cards is missing from the set of cards (e.g., a missing card in a single deck of standard playing cards), and/or that cards not expected to be present in the set of cards are not present in the set of cards (e.g., a duplicate or extra card in a single deck of standard playing cards).

As shown in FIG. 3, the card imaging system 250 may include an image sensor 252 for capturing images of cards. The term "image" as used herein means at least one of suit and rank indicia on a card and does not necessarily mean a full image of any card. The image sensor 252 may be located and configured, for example, to capture images of cards as the cards pass through the card input mechanism 120 between the pick-off rollers 128A-128C and the speed-up rollers 134A-134D. In other embodiments, the card image sensor is located in the card input area 106 beneath the card support 124 when the card support 124 is in a lowest position. In some embodiments, the card imaging system 250 may comprise a camera device that includes a complementary metal oxide semiconductor (CMOS) image sensor or a charge coupled device (CCD) image sensor. For example, the card sensing system may include a video camera imaging system as described in U.S. Pat. No. 7,677,565, which issued Mar. 16, 2010 to Grauzer et al., the disclosure of which is incorporated herein in its entirety by this reference.

Figure 9:
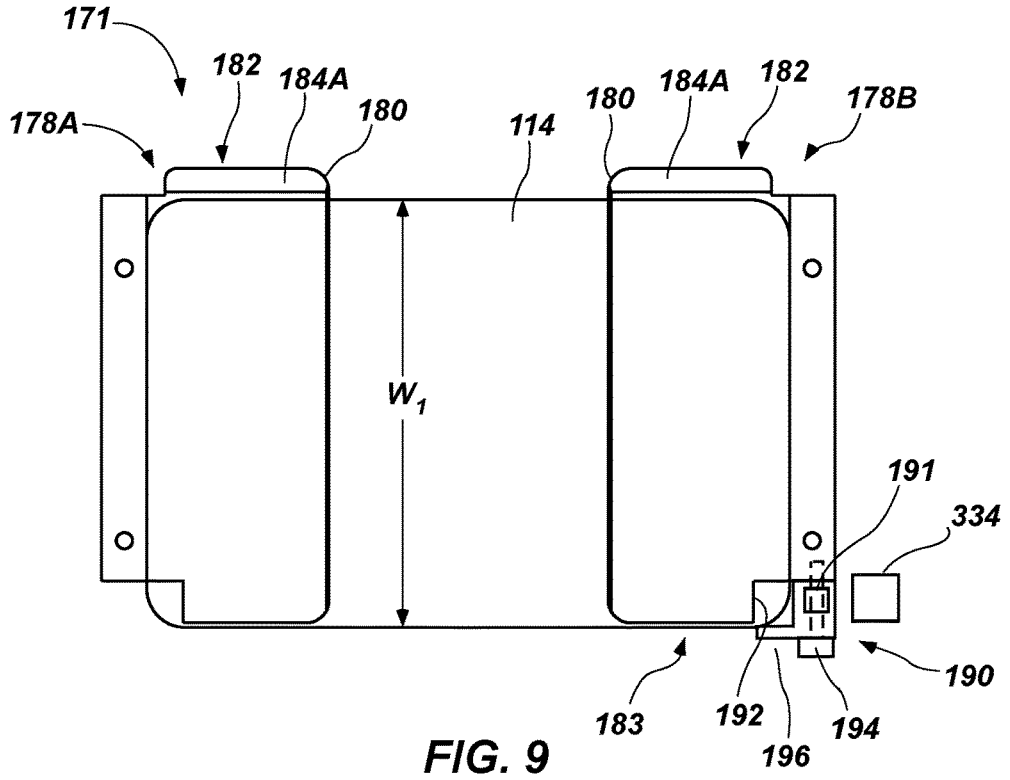
FIG. 9 is a top plan view of components of the rack illustrating the components assembled in a first configuration for use with cards of a first size.
Figure 10:
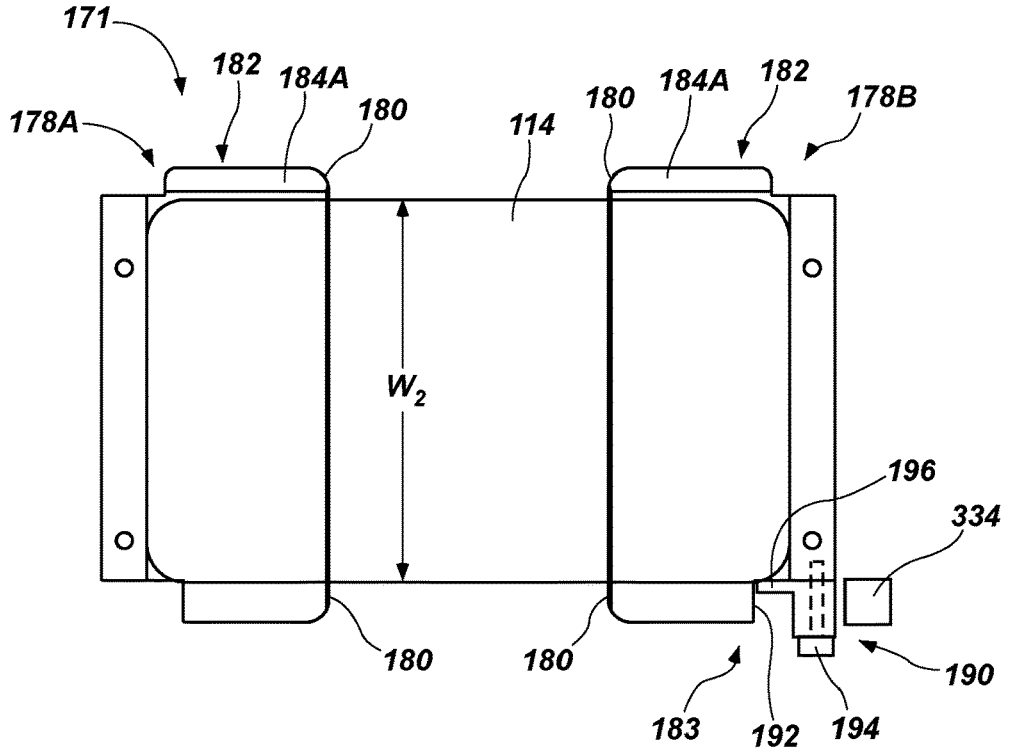
FIG. 10 is a top plan view like that of FIG. 9 illustrating the components of the rack assembled in a second configuration for use with cards of a different second size.

In some embodiments, the rack 171 of the card storage device 170 may be adaptable for use with cards having different sizes. Referring to FIGS. 9 and 10, in some embodiments, the rack 171 of the card storage device 170 may include a card size adjustment member 190 capable of being attached to, or otherwise positioned relative to the rack 171 in a first orientation for use with cards of a first size (e.g., a first height and/or width) or in a different second orientation for use with cards of a second size (e.g., a second height and/or width). For example, a notch 192 may be provided in a back side 183 of one or both of the side brackets 178A, 178B. The card size adjustment member 190 then may be configured as an elongated bar or rod (extending into the plane of FIGS. 9 and 10) that may be attached to one or both of the side brackets 178A, 178B within the notch 192 using one or more fasteners 194 (e.g., screws). The card size adjustment member 190 may include a projection 196 against which edges of cards 114 may abut when the cards 114 are inserted into the card storage compartments 172 in the rack 171.

As shown in FIG. 9, the card size adjustment member 190 may be attached to the second side bracket 178B within the notch 192 such that the projection 196 is located farther from the ends 182 of the ribs 180 having the tapered surfaces 184A, 184B, such that a card 114 having a first width $W_1$ (e.g., a standard poker card having a width of about 2.5 inches) may be received completely within any of the card storage compartments 172 in the rack 171. Referring to FIG. 10, the card storage device 170 may be adapted for use with cards 114 having a smaller second width $W_2$ (e.g., a standard bridge card having a width of about 2.25 inches) by moving the card size adjustment member 190 relative to the second side bracket 178B of the rack 171 to a different second orientation, wherein the projection 196 is located closer to the ends 182 of the ribs 180 having the tapered surfaces 184A, 184B. Thus, the width of the card storage compartments 172 may be between about 0.20 inches and about 0.30 inches (e.g., about 0.25 inches) less, due to the position of the projection 196, when the card size adjustment member 190 is attached to the second side bracket 178B in the second orientation compared to when the card size adjustment member 190 is attached to the second side bracket 178B in the first orientation. Thus, the card size adjustment member 190 is capable of being positioned relative to the rack 171 in a first orientation (FIG. 9) and a different second orientation (FIG. 10), and each of the plurality of card storage compartments 172 in the rack 171 has a first size when the card size adjustment member 190 is positioned relative to the rack 171 in the first orientation and a different second size when the card size adjustment member 190 is positioned relative to the rack 171 in the second orientation.

In some embodiments, the card shuffler 100 may include a sensor 334 configured to detect when the card size adjustment member 190 is in the first orientation (shown in FIG. 9) or the second orientation (FIG. 10) relative to the rack 171. For example, a magnet 191 may be provided on or in the card size adjustment member 190 at a selected location, and a Hall effect sensor 334 may be located and configured to sense or otherwise detect the proximity of the magnet 191 to the Hall effect sensor 334 when the card size adjustment member 190 is in the first orientation (shown in FIG. 9) or in the second orientation (FIG. 10), but not both. For example, the magnet 191 may be located proximate the sensor 334 when the card size adjustment member 190 is in the first orientation (FIG. 9), but not when the card size adjustment member 190 is in the second orientation (FIG. 10). The sensor 334 may be coupled to the control system 280 (FIG. 13) of the card shuffler 100, such that the control system 280 may determine whether the rack 171 is configured for use with cards 114 having the first larger width $W_1$ (FIG. 9) or with cards 114 having the second smaller width $W_2$ (FIG. 10).

In some embodiments, the card shuffler 100 may also be adaptable for use with cards having different thicknesses. For example, the card shuffler 100 may include an adjustable brake roller assembly 156 shown in FIGS. 11 and 12. The brake roller assembly 156 may include a bracket 158 and a brake roller 160. The brake roller assembly 156 may be mounted within the card shuffler 100 such that the brake roller 160 is disposed proximate the pick-off roller 128C (as shown in FIG. 3) so as to dispose a card gap between the brake roller 160 and the pick-off roller 128C through which cards pass as they move through the card input mechanism 120 toward the card storage device 170. The brake roller 160 may be configured to move relative to the bracket 158 to selectively adjust the thickness of the card gap between the brake roller 160 and the pick-off roller 128C. The bracket 158 may be fixedly mounted to the frame. For example, as shown in FIGS. 11 and 12, the brake roller assembly 156 may include a rotatable dial 162. Rotation of the dial 162 may cause the brake roller 160 to move toward or away from the bracket 158, which may be mounted at a fixed location within the card shuffler 100, so as to adjust the card gap between the brake roller 160 and the pick-off roller 128C. The rotatable dial 162 may be biased to discrete rotational positions, such that rotation of the dial 162 between rotationally adjacent rotational positions causes the card gap to increase or decrease by predefined distances. In some embodiments, most, if not all, of the predefined distances may be at least substantially uniform (e.g., about 0.003 inches).

Figure 12:
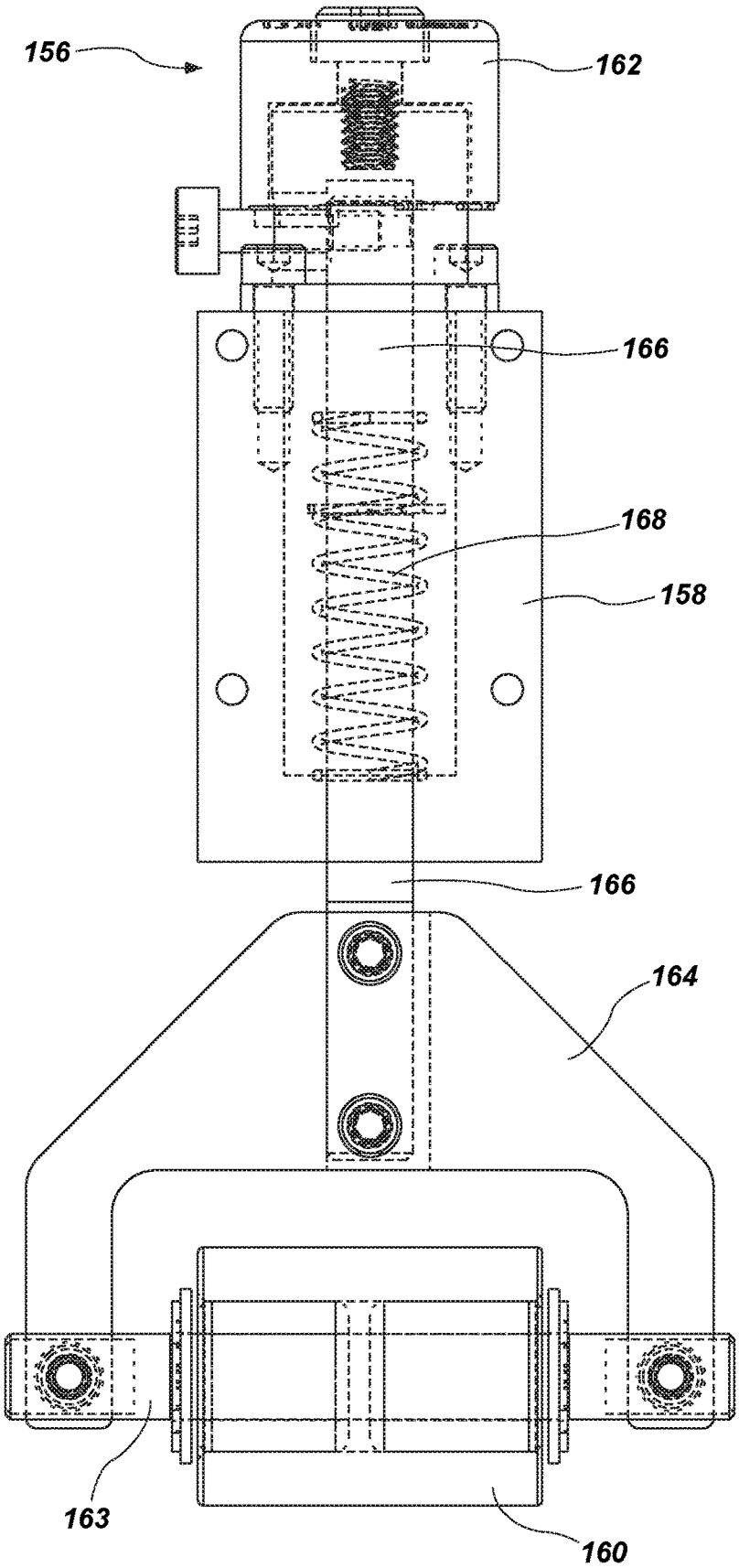
FIG. 12 is an elevational view of a back side of the brake roller assembly of FIG. 11.

As shown in FIG. 12, in one particular non-limiting embodiment, the brake roller 160 may be mounted on an axle 163. The axle 163 may be attached to a U-shaped bracket 164, which may be attached to a first end of a rod 166 extending through the bracket 158 of the brake roller assembly 156. An opposite second end of the rod 166 may be engaged to the dial 162 by a threaded coupling. The dial 162 may be fixed in position relative to the bracket 158 such that, as the dial 162 is rotated relative to the bracket 158, the threaded coupling between the dial 162 and the rod 166 causes the rod 166 to move up or down within the bracket 158 depending on the direction of rotation of the dial 162. A spring 168 may be used to bias the rod 166 (and, hence, the brake roller 160) in the upward direction away from the pick-off roller 128C (FIG. 3).

Figure 11:
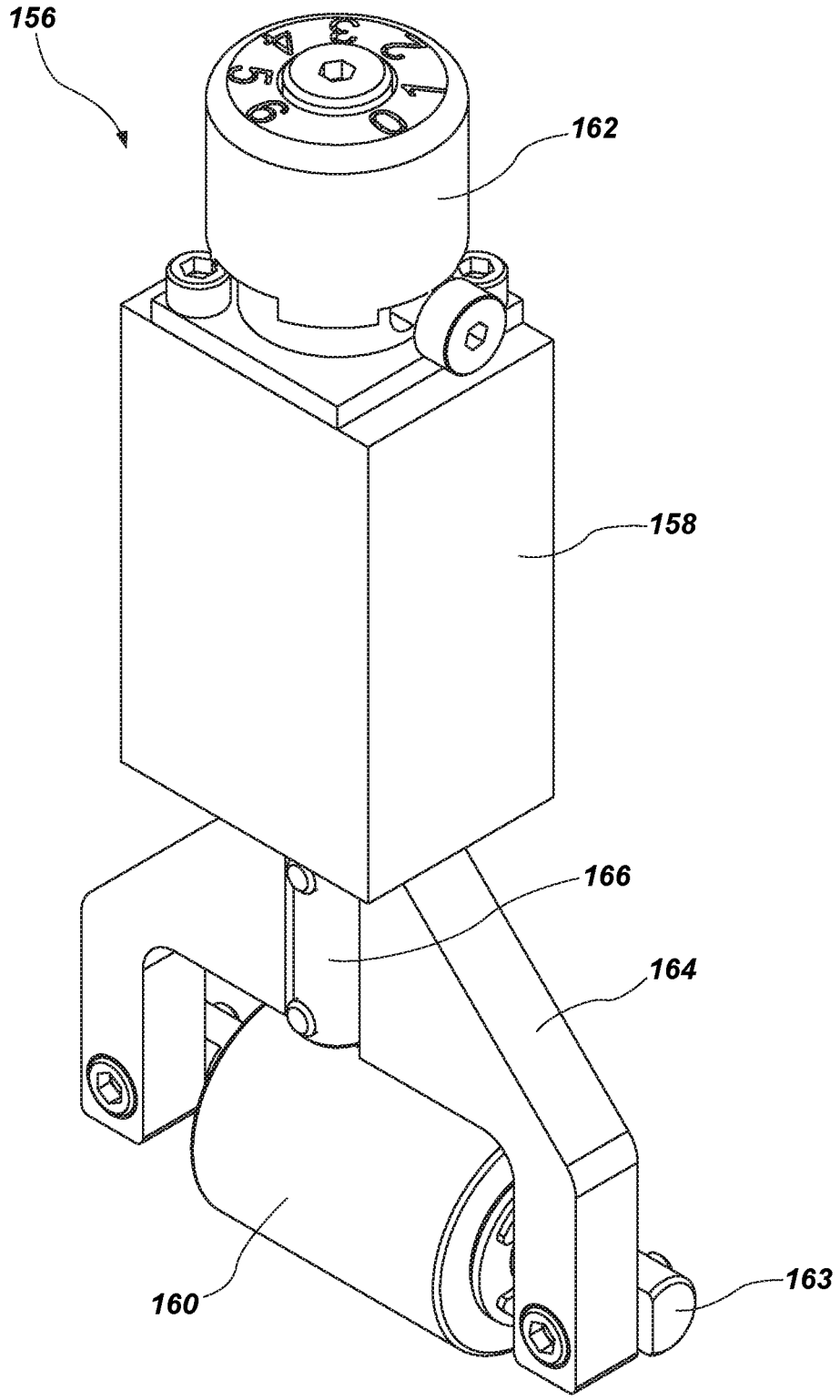
FIG. 11 is a front isometric view of a brake roller assembly of the card shuffler.

Using the adjustable brake roller assembly 156 shown in FIGS. 11 and 12, the card shuffler 100 may be adapted for use with cards of different thicknesses. Cards may be driven through the card gap between the pick-off roller 128C and the brake roller 160 of the brake roller assembly 156, and the brake roller 160 may be moved relative to the bracket 158 of the brake roller assembly 156 to selectively adjust the card gap between the brake roller 160 and the pick-off roller 128C by selectively rotating the dial 162. The dial 162 may be selectively rotated until the card gap is sized to allow a single card to pass through the card gap, but to prevent two or more cards from passing together through the card gap at the same time. In this matter, the brake roller 160 sequentially breaks single cards away from the stack of cards on the card support 124 of the card input mechanism 120 one card at a time.

Figure 13:
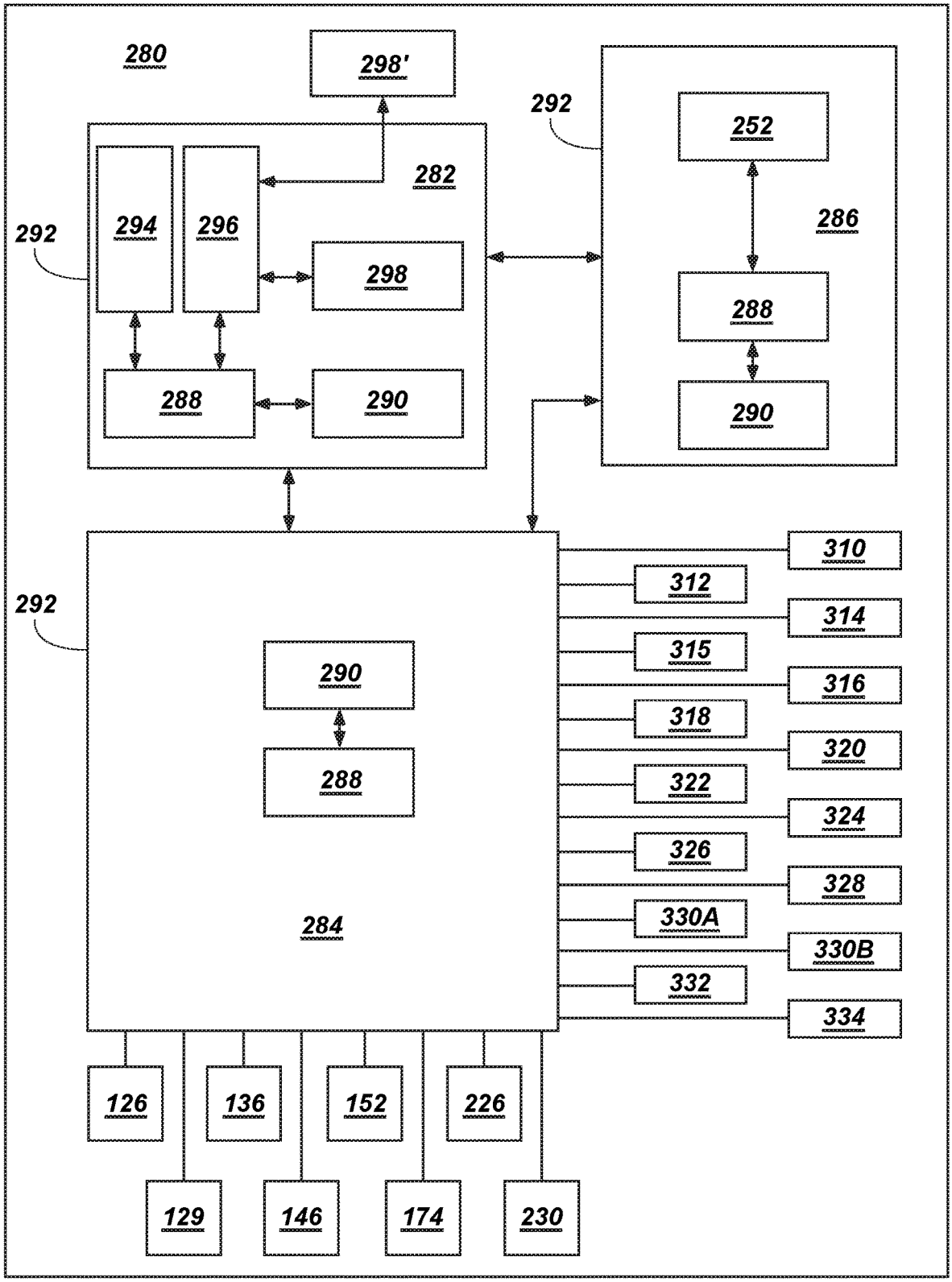
FIG. 13 is a block diagram illustrating various components of a control system of the card shuffler.

Referring to FIG. 13, the card shuffler 100 may comprise a control system 280 for controlling operation of the various active components of the card shuffler 100, for receiving data input from a user of the card shuffler 100, and for outputting data and/or information to a user of the card shuffler 100. FIG. 13 illustrates a non-limiting example embodiment of a control system 280 that may be used for controlling the card shuffler 100. The control system 280 may include one or more control modules for performing different functions of the control system 280, which control modules may be operatively coupled together. For example, the control system 280 may include a main control module 282, a motor/sensor control module 284, and an imaging control module 286. As shown in FIG. 13, the main control module 282 may be configured to communicate electrically with (i.e., send electronic signals to, and/or receive electronic signals from) each of the motor/sensor control module 284 and the imaging control module 286. The communication between modules 282, 284, and 286 may be either direct or indirect. For example, one or more wires or other electrical communication pathways may extend between the main control module 282 and each of the motor/sensor control module 284 and the imaging control module 286. In some embodiments, the imaging control module 286 may be configured to communicate electrically with the motor/sensor control module 284, either indirectly through the main control module 282 or directly by way of one or more wires or other electrical communication pathways that extend directly between the imaging control module 286 and the motor/sensor control module 284.

Each of the main control module 282, the motor/sensor control module 284, and the imaging control module 286 may include one or more electronic signal processors 288 for processing electronic signals, and one or more memory devices 290 (e.g., random access memory (RAM), read-only memory (ROM), Flash memory, etc.) for storing electronic data therein. Each of the main control module 282, the motor/sensor control module 284, and the imaging control module 286 may comprise a printed circuit board 292, to which the electronic signal processors 288 and memory devices 290 may be respectively coupled.

Figure 6:
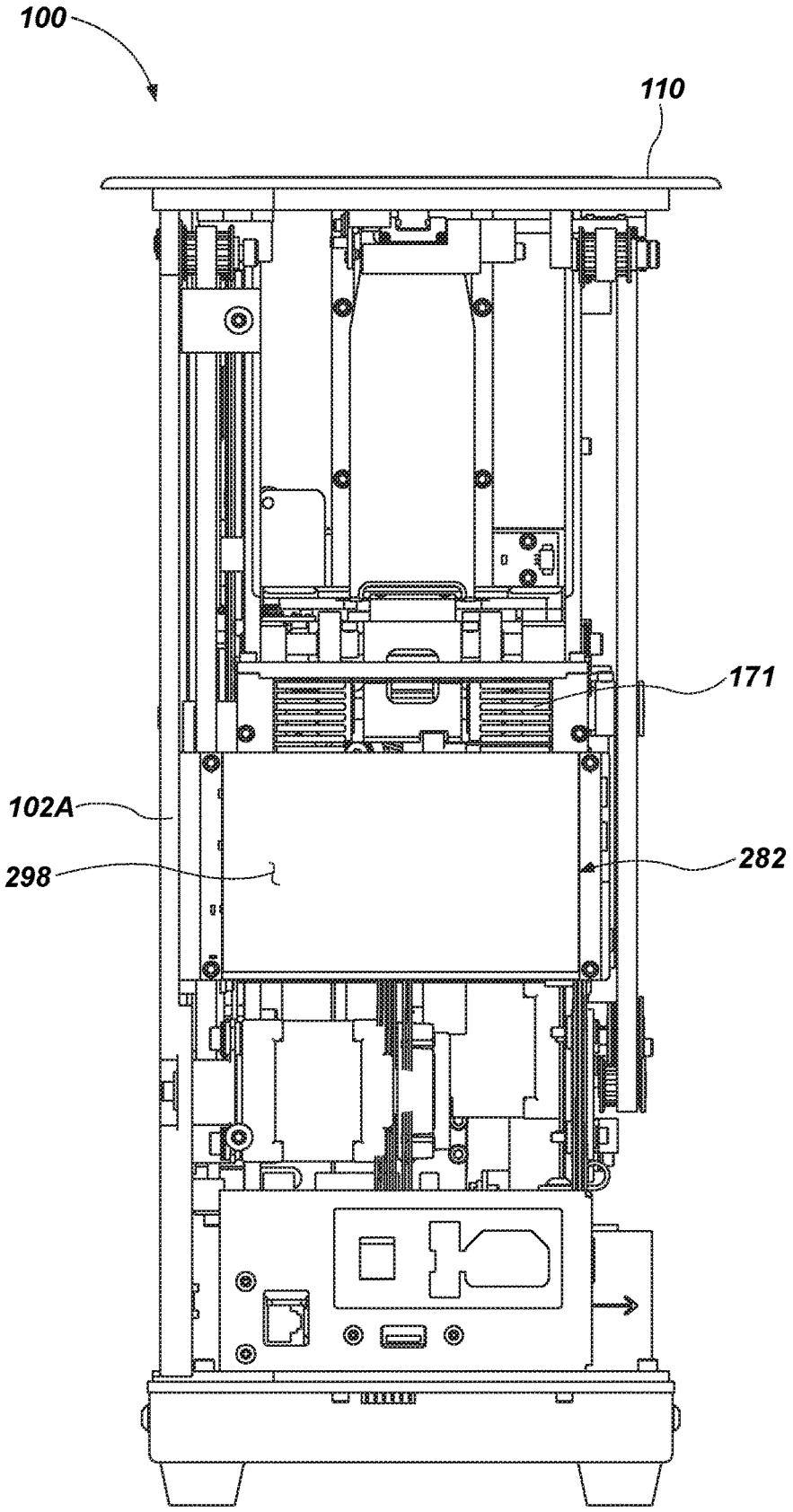
FIG. 6 is a fourth side elevational view of a back side of the card shuffler with the outer cover removed.
Figure 7:
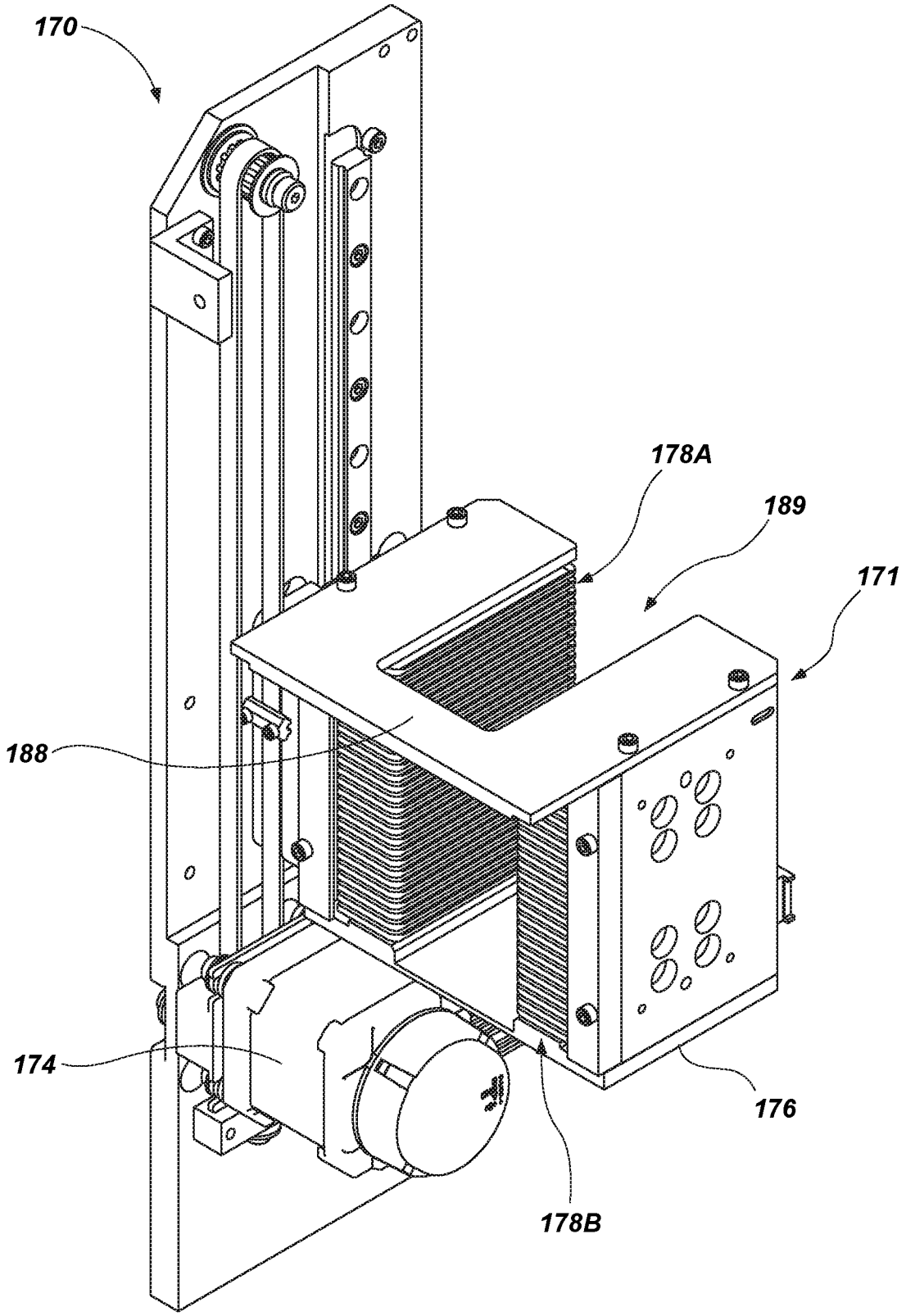
FIG. 7 is an isometric view of a rack of the card shuffler that includes multiple card storage compartments and an associated mechanism for vertically moving the rack up and down within the card shuffler.

The main control module 282, the motor/sensor control module 284, and the imaging control module 286 may be mounted within the card shuffler 100. In some embodiments, the main control module 282, the motor/sensor control module 284, and the imaging control module 286 may be mounted at different locations within the card shuffler 100. For example, as shown in FIG. 6, the main control module 282 may be mounted to a side member 102A of the frame 102. The motor/sensor control module 284 may be mounted to a lower base member 204B (FIG. 4) of the frame 102 (although the motor/sensor control module 284 is not visible in FIG. 4), and the imaging control module 286 may be mounted to another side member 204C (FIG. 5) of the frame 102 (although the imaging control module 286 is not visible in FIG. 5). In some embodiments, the image sensor 252 of the card imaging system 250 may be mounted directly to the printed circuit board 292 of the imaging control module 286, and the imaging control module 286 may be mounted within the card shuffler 100 at a location at which the image sensor 252, while mounted to the printed circuit board 292, may capture images of cards as the cards pass through the card input mechanism 120 between the pick-off rollers 128A-128C and the speed-up rollers 134A-134D, as previously described.

With continued reference to FIG. 13, the main control module 282 may include a data input device 294 configured to allow a user to input data into the control system 280, and a data output device 296 configured to display information to a user. In some embodiments, the data input device 294 and the data output device 296 may comprise a single, unitary device, such as a touch-screen display that can be used both to display information to a user, and to receive input from a user. In some embodiments, the control system 280 may include a first control panel 298 located within the automatic card shuffler 100 such that the first control panel 298 is inaccessible to a user of the automatic card shuffler 100 from outside the automatic card shuffler 100, and a second control panel 298' located at least partially outside the automatic card shuffler 100 such that the second control panel 298' is accessible to a user of the automatic card shuffler 100 from outside the automatic card shuffler 100. The first and second control panels 298, 298' each may comprise touch-screen displays, which may be operatively coupled with the main control module 282. In some embodiments, the first and second control panels 298, 298' may be mirrored with one another, such that what is displayed on one is exactly the same as what is displayed on the other, and such that the card shuffler 100 may be controlled by inputting data into either of the control panels 298, 298'. In other embodiments, the control panel 298 may comprise a primary host control panel, and the control panel 298' may comprise a secondary control panel. In such embodiments, depending on a selectable operational mode of the card shuffler 100, either the first host control panel 298 or the secondary control panel 298' may be used. When the secondary control panel 298' is being used, the user interface to be displayed on the secondary control panel 298' may be forwarded to the secondary control panel 298' from the host primary control panel 298. When the secondary control panel 298' is being used, the first control panel 298 may display a message indicating that the secondary control panel 298' is being used. Input received from the secondary control panel 298' may be forwarded to the first host control panel 298.

The first control panel 298 may not be visible or otherwise accessible to a user of the card shuffler 100 during normal operation, and the second control panel 298' may be located outside the card shuffler 100 such that the second control panel 298' is visible and accessible to a user of the card shuffler 100 during normal operation of the card shuffler 100.

In some embodiments, the second control panel 298' may comprise a modular display unit that may be mounted to a surface of a gaming table at a location separate from the main console of the card shuffler 100 (shown in FIGS. 1 through 6), which comprises the card input mechanism 120, the card storage device 170, and the card output mechanism 220, and may be operatively coupled with the main control module 282 of the control system 280 using a wired or wireless connection. As previously mentioned, the main console of the card shuffler 100 may be configured to be mounted to a playing card table such that the upper surface 110 of the card shuffler 100 is flush with the surface of the playing card table. The second control panel 298' also may be configured to be flush-mounted to the surface of the playing card table at a location separated by a distance from the location at which the main console of the card shuffler 100 is to be mounted. In other embodiments, the second control panel 298' may be mounted above the surface of the playing card table.

The first control panel 298 may be mounted directly to the printed circuit board 292 of the main control module 282 in some embodiments. The first control panel 298 may be adapted and used for installation, initial set-up, and maintenance of the card shuffler 100, while the second control panel 298' may be adapted and used for controlling operation of the card shuffler 100 during normal use of the card shuffler 100 for shuffling, sorting, and verification of cards. The internal control panel 298 may be used for maintenance, upgrades and repairs when the external control panel 298' is located in a position spaced apart from the card shuffler 100.

In other embodiments, however, the card shuffler 100 may include a single data input device 294 and a single data output device 296, such as a single control panel 298 comprising a touch-screen display, which may be located anywhere on the card shuffler 100 (e.g., on the inside or the outside of the card shuffler 100) or remote from the card shuffler 100.

The main control module 282 may include one or more computer programs stored electronically in the memory device or devices 290 thereof, which computer programs may be configured to control operation of the various active components of the card shuffler 100.

The motor/sensor control module 284 may be configured to control operation of the various motors within the card shuffler 100, and to receive signals from various sensors within the card shuffler 100. The various sensors of the card shuffler 100 may be used by the control system 280 to identify current operational states of the various active components of the card shuffler 100, such as locations of the movable components of the card shuffler 100.

For example, each of the motor 126 for the input elevator 122, the motor 129 for the pick-off rollers 128A-128C, the motor 136 for the speed-up rollers 134A-134D, the motor 146 for the card packer arm 144, the card weight motor 152 for the card weight device (not visible), the motor 174 for the rack 171, the motor 226 for the output elevator 222, and the motor 230 for the ejector 228 may be electrically coupled with the motor/sensor control module 284 to allow the motor/sensor control module 284 to independently, selectively activate and deactivate the motors as needed to control operation of the card shuffler 100.

The card shuffler 100 may include a number of sensors, which also may be operatively coupled with the motor/sensor control module 284. By way of example and not limitation, the card shuffler 100 may include a card sensor 310 configured to detect the presence of one or more cards on the card support 124 of the card input mechanism 120, a first input elevator sensor 312 located and configured to detect when the input elevator 122 is in the uppermost position, and a second input elevator sensor 314 located and configured to detect when the input elevator 122 is in the lowermost position. A card weight sensor 315 may be located and configured to detect whether the card weight device is in the activated and/or deactivated position. A card sensor 316 may be located and configured to detect the presence of a card as the card moves off the card support 124 responsive to actuation of the pick-off rollers 128A-128C. The card sensor 316 may be activated by the leading edge of the card substantially immediately as the card begins to move off from the card support 124.

A sensor 318 may be located and configured to detect when a card moving responsive to actuation of the pick-off rollers 128A-128C approaches the speed-up rollers 134A-134D. The sensor 318 may be located and configured such that the sensor 318 may be triggered by a moving card prior to the leading edge of the moving card engaging the speed-up rollers 134A-134D. In some embodiments, the sensor 318 may be used to trigger activation of the image sensor 252 of the card imaging system 250 to acquire one or more images of the card. Optionally, the sensor 318 may be used by the motor/sensor control module 284 to momentarily deactivate movement of the pick-off rollers 128A-128C while the image sensor 252 of the card imaging system 250 acquires one or more images of the card, after which the motor/sensor control module 284 may reactivate movement of the pick-off rollers 128A-128C to cause the card to be engaged by the speed-up rollers 134A-134D and inserted into the card storage device 170. The sensor 318 may comprise a photoactive sensor that includes an emitter for emitting radiation toward any card present proximate the sensor 318, and one or more receivers for receiving radiation emitted by the emitter and reflected from a surface of a card. In some embodiments, the photoactive sensor may include two radiation receivers oriented at different locations along the direction of movement of the cards, such that the photoactive sensor may determine a direction of movement of any card moving proximate the sensor 318 by detecting which of the two radiation receivers receives reflected radiation first as a card moves past the sensor 318.

A sensor 320 may be located and configured to detect when a card moving responsive to activation of the speed-up rollers 134A-134D passes by the speed-up rollers 134A-134D and begins to enter the card storage device 170. In some embodiments, the sensor 320 may comprise a photoactive sensor that includes one or more emitters for emitting radiation toward any card present proximate the sensor 320, and two or more receivers for receiving radiation emitted by the emitter and reflected from a surface of a card. The two or more radiation receivers may be oriented at different locations along the direction of movement of the cards, such that the photoactive sensor may determine a direction of movement of any card moving proximate the sensor 320 by detecting which of the two radiation receivers receives reflected radiation first as a card moves past the sensor 320. Thus, the sensor 320 may be capable of detecting the presence of a card proximate the sensor 320, and capable of detecting whether the card is moving into the card storage device 170 or out from the card storage device 170. The speed-up rollers 134A-134D may be capable of pushing a card toward and into the card storage device 170, and capable of pulling a card back away from the card storage device 170. For example, in the case of a card jam wherein a card being inserted into the card storage device 170 is not actually inserted into the card storage device 170 as intended, the direction of rotation of the speed-up rollers 134A-134D may be reversed to withdraw the card from the card storage device 170, after which the position of the card storage device 170 may be adjusted and the speed-up rollers 134A-134D activated to again attempt to insert the card into the card storage device 170. If the card cannot be inserted into the card storage device 170 upon a predetermined number of attempts, operation of the card shuffler 100 may be interrupted and an error message provided to a user via the data output device 296 of the control system 280.

The card shuffler 100 may further include one or more packer sensors 322 located and configured to sense a position of the card packer arm 144. For example, a packer sensor 322 may be located and configured to sense when the card packer arm 144 is in the retracted position. One or more rack sensors 324 may be located and configured to sense a position of the rack 171. For example, a rack sensor 324 may be located and configured to sense when the rack 171 is in the lowermost position. The card shuffler 100 may further include one or more ejector sensors 326. For example, the card shuffler 100 may include an ejector-out sensor 326 located and configured to sense when the ejector 228 is disposed in the first position on the lateral side of the rack 171 proximate the card support 224, and an ejector-in sensor 326 located and configured to sense when the ejector 228 is disposed in the second position on an opposing lateral side of the rack 171 remote from the card support 224.

The card shuffler 100 may include a card sensor 328 located and configured to detect the presence of one or more cards on the card support 224 of the card output mechanism 220, a first output elevator sensor 330A located and configured to detect when the output elevator 222 is in the lowermost position, and a second output elevator sensor 330B located and configured to detect when the output elevator 222 is in the uppermost position. The card shuffler 100 may include a lid sensor 332 located and configured to detect when the lid 112 is in the closed position, as shown in FIG. 1. As previously discussed with reference to FIGS. 9 and 10, the card shuffler 100 may include a card size sensor 334 located and configured to detect when the card size adjustment member 190 is in the first orientation (shown in FIG. 9) or the second orientation (FIG. 10) relative to the rack 171.

The card shuffler 100 may be used to shuffle cards, to sort cards, and/or to verify cards or sets of cards.

For example, the card shuffler 100 may be used to perform a shuffling operation on a stack of cards, as described below with reference to FIGS. 14A through 14H and FIG. 15. The card shuffler 100 may be placed in a shuffling mode using the data input device 294 of the control system 280. If the input elevator 122 and the output elevator 222 are not in the raised uppermost positions and the lid 112 open (as shown in FIG. 2), a start button 299 (FIGS. 1 and 2) on the upper surface 110 of the card shuffler 100 may be pressed to cause the input elevator 122 and the output elevator 222 to raise to uppermost positions and raise the lid 112.

Figure 14A:
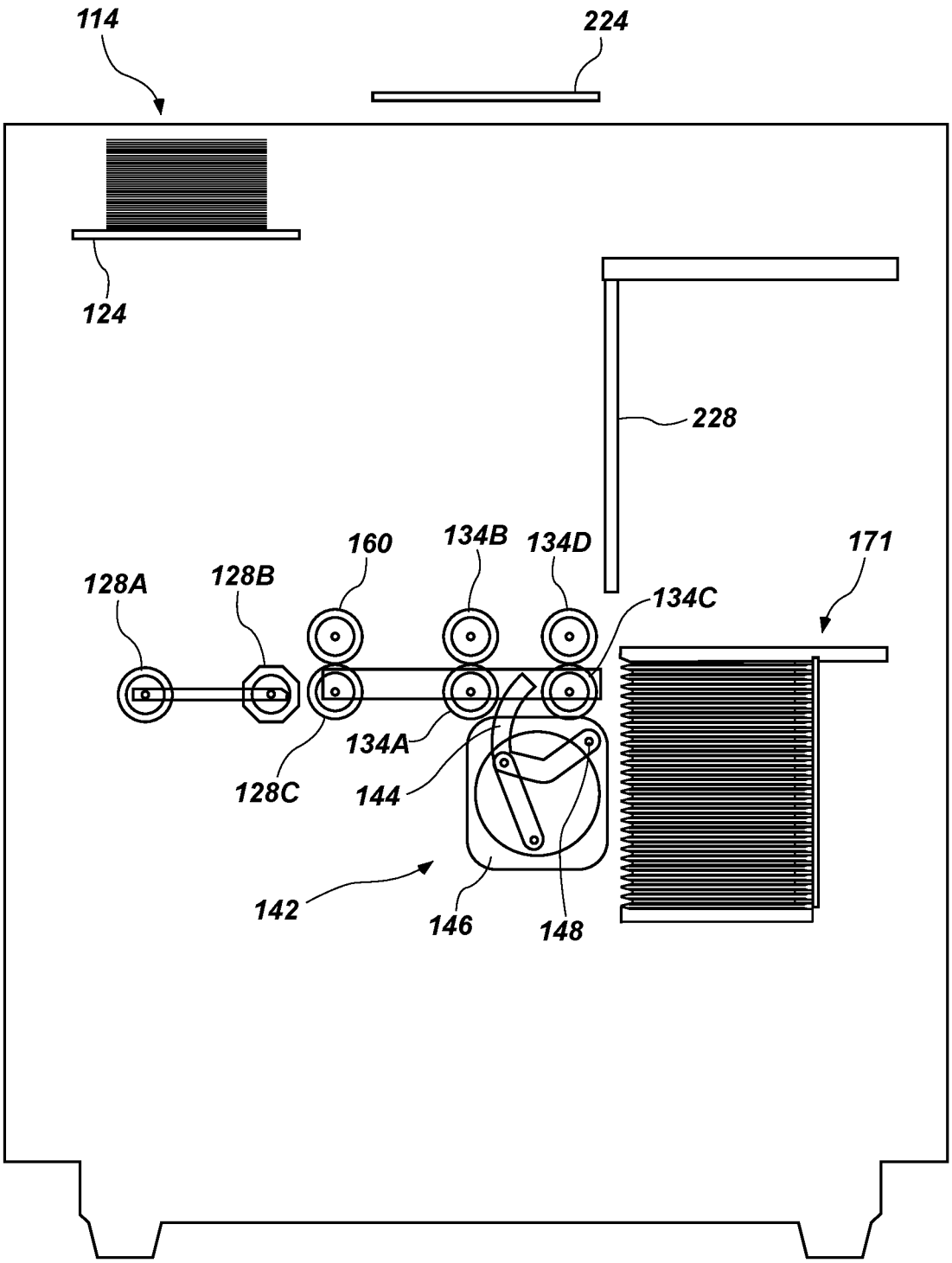
FIGS. 14A-14H are simplified and schematically illustrated cross-sectional views taken through the card shuffler apparatus along a plane parallel to the left and right sides of the automatic card shuffler (and perpendicular to the front and back sides of the automatic card shuffler), wherein various components and features of the card shuffler have been removed to facilitate illustration and description of operation of the card shuffler.
Figure 14B:
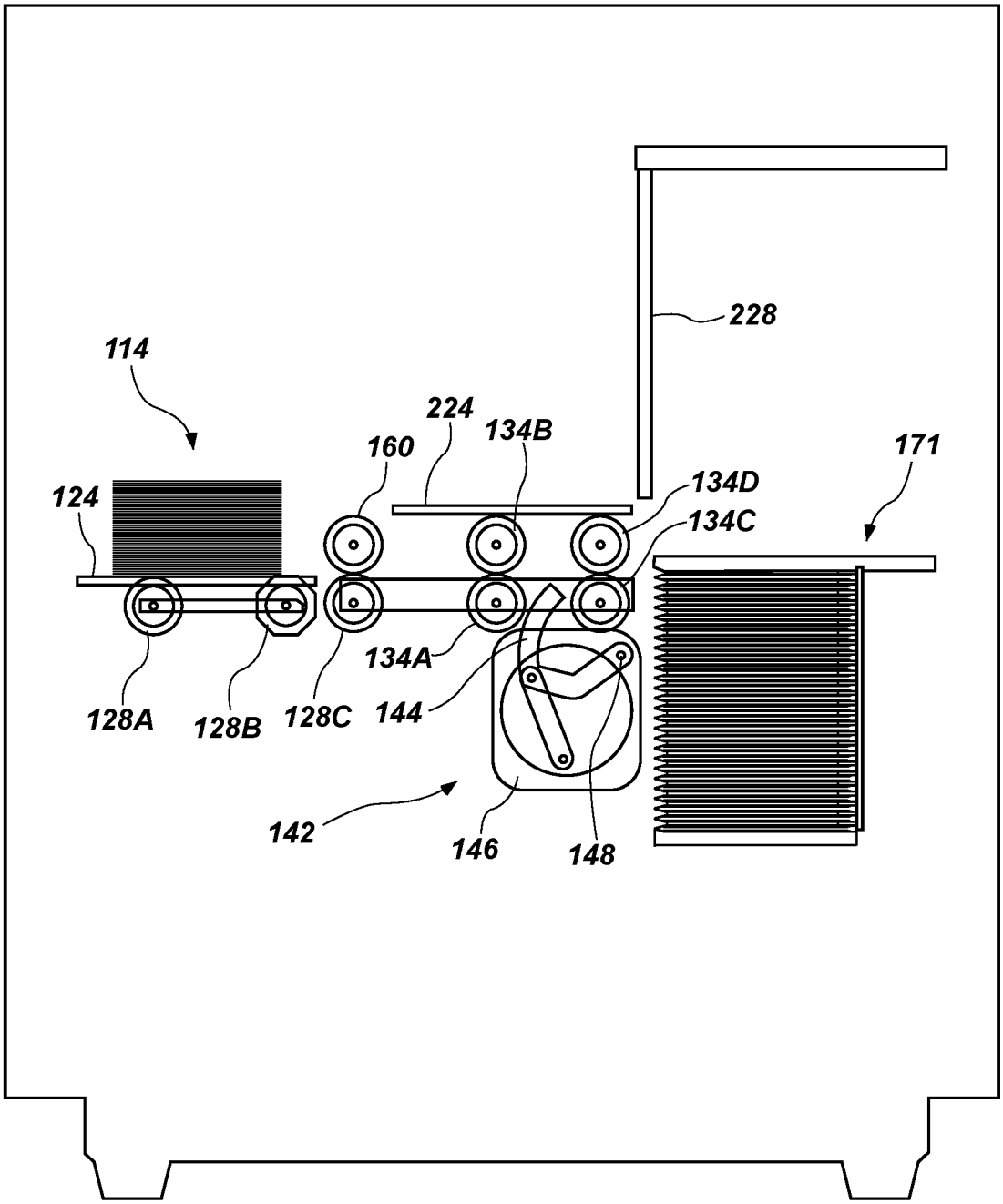
Figure 14C:
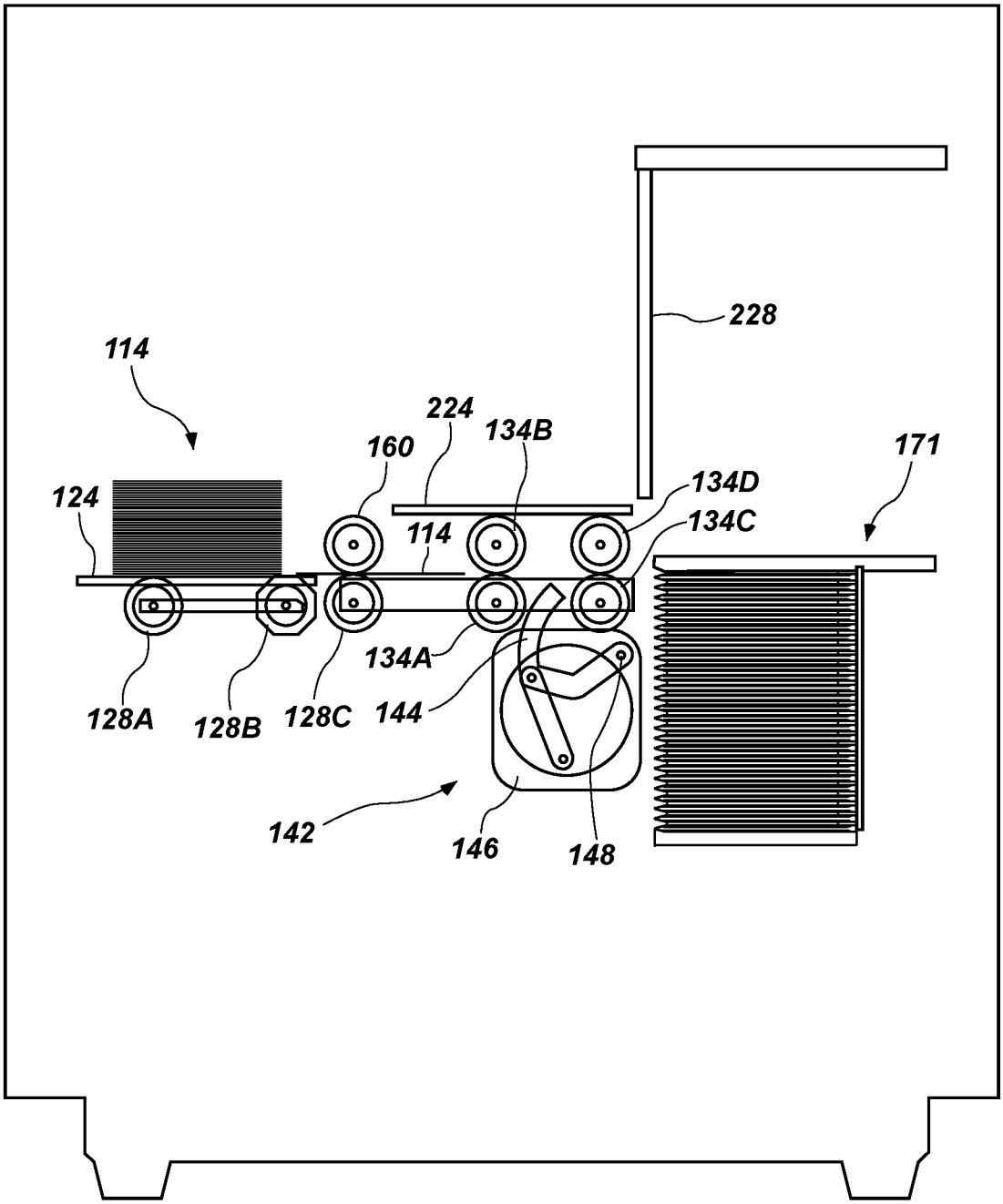
Figure 15:
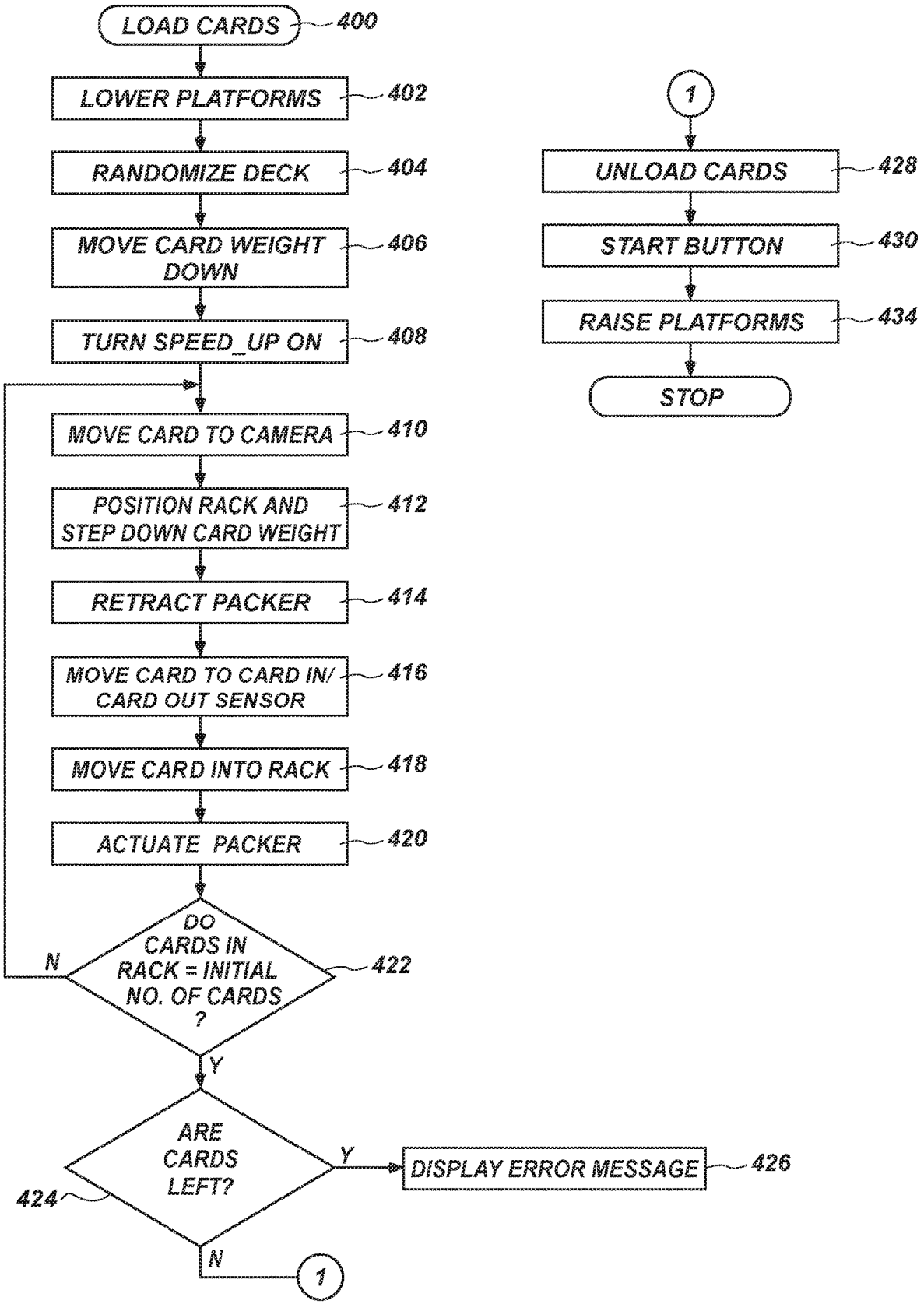
FIG. 15 is a flow chart illustrating operation of the card shuffler during a shuffling operation.

Referring to FIG. 14A, a stack of cards 114 may be placed by a user on the card support 124 of the input elevator 122, as represented in action 400 in FIG. 15. The control system 280 may be configured such that, upon detecting the presence of cards 114 on the card support 124 of the input elevator 122 using the card sensor 310 and the absence of cards on the card support 224 of the output elevator 222 using the card sensor 328 for a predetermined amount of time (e.g., five seconds), the control system 280 may automatically commence a shuffling operation by lowering the input elevator 122 and the output elevator 222 to the lowermost positions and closing the lid 112, as shown in FIG. 14B and represented as action 402 in FIG. 15.

As previously mentioned, the card shuffler 100 may be configured for use in shuffling single fifty-two (52) card decks of standard playing cards, which may optionally include two additional cards, such as Jokers, for a total of fifty-four (54) cards to be shuffled. In such a configuration, the rack 171 may include exactly twenty-seven (27) card storage compartments 172 (FIGS. 7 through 10), each of which may be sized and configured to hold two or less (but no more than two in some embodiments) cards therein at any given time. Thus, the rack 171 may include fifty-four (54) card storage positions, wherein an upper position and a lower position are designated within each card storage compartment 172. In some embodiments, one or two additional shelves are provided to create a location to load cards that cannot be loaded into a designated compartment. Because each card storage compartment 172 may include zero, one, or two cards therein at any given time, the upper and lower positions within each card storage compartment 172 are virtual positions until all cards have been inserted into the card storage compartments 172 by the card input mechanism 120, at which time a card is positioned in a lower position in each card storage compartment 172 and another card is positioned in an upper position in each card storage compartment 172.

To shuffle cards or "randomize" the deck, as indicated at action 404 in FIG. 15, the control system 280 of the card shuffler 100 creates a table that randomly assigns and correlates the cards in the stack to one of the fifty-four (54) card storage positions in the rack 171. The control system 280 sequentially numbers the cards from the bottom card in the stack of cards 114 toward the top of the stack of cards 114 by sequentially assigning an integer to each card. The control system 280 also sequentially numbers the card storage positions in the rack 171. For example, the top card storage position in the rack 171 may be designated as card storage position "1," and the bottom card storage position in the rack 171 by be designated as card storage position "54," and the card storage positions therebetween may be sequentially numbered. A portion of the positions may be assigned to an upper portion of a compartment and another portion may be assigned to a lower portion. In one embodiment, between 27 and 29, compartments are needed to put a deck of 54 cards in a desired order (random or pre-determined). Two extra compartments are provided to accept cards that cannot be delivered to the assigned compartment due to card jams, warped cards, damaged cards, etc.

Thus, the control system 280 may randomly assign and correlate cards in the stack of cards 114 resting on the card support 124 of the card input elevator 122 to card storage positions in the rack 171. For example, the control system 280 may include a random number generator, which may be used to randomly assign and correlate cards in the stack of cards 114 resting to the card storage positions in the rack 171. The control system 280 may generate a Card Position Table, such as Table 1 below, which includes randomly assigned card storage positions for each sequential card in the stack of cards 114 on the card support 124 of the card input elevator 122. The Position Table may be stored in a memory device 290 of the control system 280 (FIG. 13).

TABLE 1

| Card Position Table | |
|---|---|
| Card | Position |
| 0 | 44 |
| 1 | 21 |
| 2 | 37 |
| 3 | 2 |
| 4 | 19 |
| 5 | 45 |
| 6 | 52 |
| 7 | 36 |
| 8 | 28 |
| 9 | 6 |
| . | . |
| . | . |
| . | . |
| 48 | 53 |
| 49 | 20 |
| 50 | 39 |
| 51 | 35 |
| 52 | 27 |
| 53 | 48 |

After randomizing the deck by randomly assigning the fifty-four (54) card storage positions to the cards in the stack of cards 114 on the card support 124 of the card input elevator 122, the card shuffler 100 may move the card weight (not shown) down onto the stack of cards 114 to apply a downward force on the stack of cards 114, as indicated at action 406 in FIG. 15. The card shuffler 100 then may actuate rotation of the speed-up rollers 134A-134D, as indicated at action 408 in FIG. 15. The card shuffler 100 then may employ the card input mechanism 120 to sequentially move the cards in the stack of cards 114 resting on the card support 124 into randomly selected card storage positions within the rack 171 of the card storage device 170.

The control system 280 may selectively control movement of the various components of the card input mechanism 120 and the card storage device 170 to cause the cards in the stack of cards 114 to be inserted into the rack 171 and positioned in their randomly assigned card storage positions. To accomplish insertion of the cards into the rack 171, the rack 171 is moved up and down in the vertical direction to a proper position relative to the speed-up rollers 134A-134D (which are disposed at a fixed, static location within the card shuffler 100) for insertion of each card into the appropriate card storage compartment 172 and into its assigned card storage position.

When any card is inserted into a card storage compartment 172 in the rack 171, there are two states that may exist. The first possible state is the state wherein no other card is present in the respective card storage compartment 172, and the second possible state is the state wherein one card is already present in the respective card storage compartment 172. The control system 280 may include to a First Rack Position Table and a Second Rack Position Table, each of which may be stored in the memory device 290 of the control system 280. The First Rack Position Table may include the positions at which the rack 171 is to be located for insertion of a card into a card storage compartment 172 when there is no card already present in the respective card storage compartment 172. The Second Rack Position Table may include the positions at which the rack 171 is to be located for insertion of a card into a card storage compartment 172 where there is already a card present in the respective card storage compartment 172. Thus, the First Rack Position Table correlates appropriate rack locations to each of the twenty-seven (27) card storage compartments 172, and the Second Rack Position Table correlates appropriate rack locations to each of the fifty-four (54) card storage positions in the rack 171. An example First Rack Position Table is shown in Table 2 below, and an example Second Rack Position Table is shown in Table 3 below.

TABLE 2

1st Rack Position Table

| Compartment | Rack Location |
|---|---|
| 0 | 0.125 |
| 1 | 0.250 |
| 2 | 0.375 |
| 3 | 0.500 |
| 4 | 0.625 |
| . | . |
| . | . |
| . | . |
| 24 | 3.125 |
| 25 | 3.250 |
| 26 | 3.375 |

TABLE 3

2nd Rack Position Table

| Position | Rack Location |
|---|---|
| 0 | 0.085 |
| 1 | 0.165 |
| 2 | 0.210 |
| 3 | 0.290 |
| 4 | 0.335 |
| 5 | 0.415 |
| 6 | 0.460 |
| 7 | 0.540 |
| 8 | 0.585 |
| 9 | 0.665 |
| . | . |
| . | . |
| . | . |
| 48 | 3.085 |
| 49 | 3.165 |
| 50 | 3.210 |
| 51 | 3.290 |
| 52 | 3.335 |
| 53 | 3.415 |

In Tables 2 and 3 above, the locations are given in distance dimensions, wherein the distance is a relative distance from a lower, bottom surface 176 of the rack 171, the location of which may be periodically identified by the control system 280 in a calibration process, as described in further detail subsequently herein. Each position in Table 2 corresponds to a position of a horizontal plane vertically centered within the card storage compartment 172 between the ribs 180 that define the respective card storage compartment 172 therebetween. Each position in Table 3 corresponds to the position of a horizontal plane vertically centered along the respective tapered upper surfaces 184A (for upper positions within card storage compartments 172) or tapered lower surfaces 184B (for lower positions within card storage compartments 172) at the ends 182 of the ribs 180.

Using the Card Position Table and the First and Second Rack Position Tables, the control system 280 controls operation of the card input mechanism 120 and the card storage device 170 to sequentially position each card into the appropriate card storage compartment 172 (and appropriate upper or lower card storage position therein) so as to randomize the order of the cards in the rack 171. As a particular card is inserted into the rack 171, the control system 280 references the Card Position Table to determine in which of the fifty-four (54) card storage positions the card is to be positioned. The control system 280 determines whether there is already a card located in the respective card storage compartment 172 in which the card storage position is located. If there is not a card already present in the card storage compartment 172, the control system 280 references Table 2 to determine where to position the rack 171 such that, when the card is inserted into the rack 171 by the speed-up rollers 134A-134D, the card will be inserted into the center of the card storage compartment 172. If there is a card already present in the card storage compartment 172, the control system 280 references Table 3 to determine where to position the rack 171 such that, when the card is inserted into the rack 171 by the speed-up rollers 134A-134D, the card will be inserted either above or below the card already present in the card storage compartment 172. Thus, after selectively inserting the second card into any given card storage compartment 172 above or below the first card inserted into the card storage compartment 172, the two cards in the card storage compartment 172 will be appropriately positioned in the upper card storage position and the lower card storage position, respectively, in that card storage compartment 172.

FIG. 14C illustrates a first card 114 being driven from the bottommost position in the stack of cards 114 on the card support 124 by the pick-off rollers 128A-128C. As indicated in action 410 of FIG. 15, the control system 280 causes the moving card 114 to be moved to the position at which the card image sensor (an example is a camera) 252 may acquire one or more images of the card 114. As each card 114 moves from the pick-off rollers 128A-128C toward the speed-up rollers 134A-134D, movement of the leading edge of each card 114 over the sensor 318 (FIG. 13) will be detected by the sensor 318. The control system 280, upon detection of the signal generated by the sensor 318, may cause the card imaging system 250 to acquire one or more images of the of the card 114 using the card image sensor 252. The card imaging system 250 may use the acquired images to identify the card 114 (e.g., the rank and suit of a standard playing card). Upon moving all cards 114 into the card storage device 170 as described below, the control system 280 may compare the actual identity of each card in the set of cards in the rack 171 (determined using the card imaging system 250) to identities of an expected set of cards, so as to verify that cards that should not be present in the set are not included (e.g., duplicate cards of any particular rank and suit), and that cards that should be present are not absent. Thus, the accuracy and completeness of a set of cards being shuffled by the card shuffler 100 (e.g., a single deck of standard playing cards) may be automatically verified by the control system 280 of the card shuffler 100 with each shuffling operation performed by the card shuffler 100. The card shuffler 100 may be configured to dispense the shuffled cards from the rack 171 only if the verification process determines the accuracy and completeness of the set of cards. In the event the verification process determines that the set of cards is incomplete or otherwise inaccurate, the card shuffler 100 may be configured not to dispense the shuffled cards and to display an error message or other signal to a user using the data output device 296 of the control system 280.

After acquiring one or more images of the card 114, the card 114 may be moved into the rack 171 using the speed-up rollers 134A-134D and the card packer arm 144 of the card packing device 142. As indicated at action 412 in FIG. 15, the control system 280 may move the rack 171 to the appropriate vertical position for insertion of the card 114 into the rack 171, as described above. The control system 280 then may retract the card packer arm 144 of the packing device 142 (as needed) as indicated at action 414 of FIG. 15. The control system 280 then may actuate rotation of the pick-off rollers 128A-128C to cause the card 114 to be gripped by the rotating speed-up rollers 134A-134D, which will move the card 114 toward the card in/card out sensor 320 and into the rack 171, as indicated at actions 416 and 418, respectively, in FIG. 15.

Figure 14D:
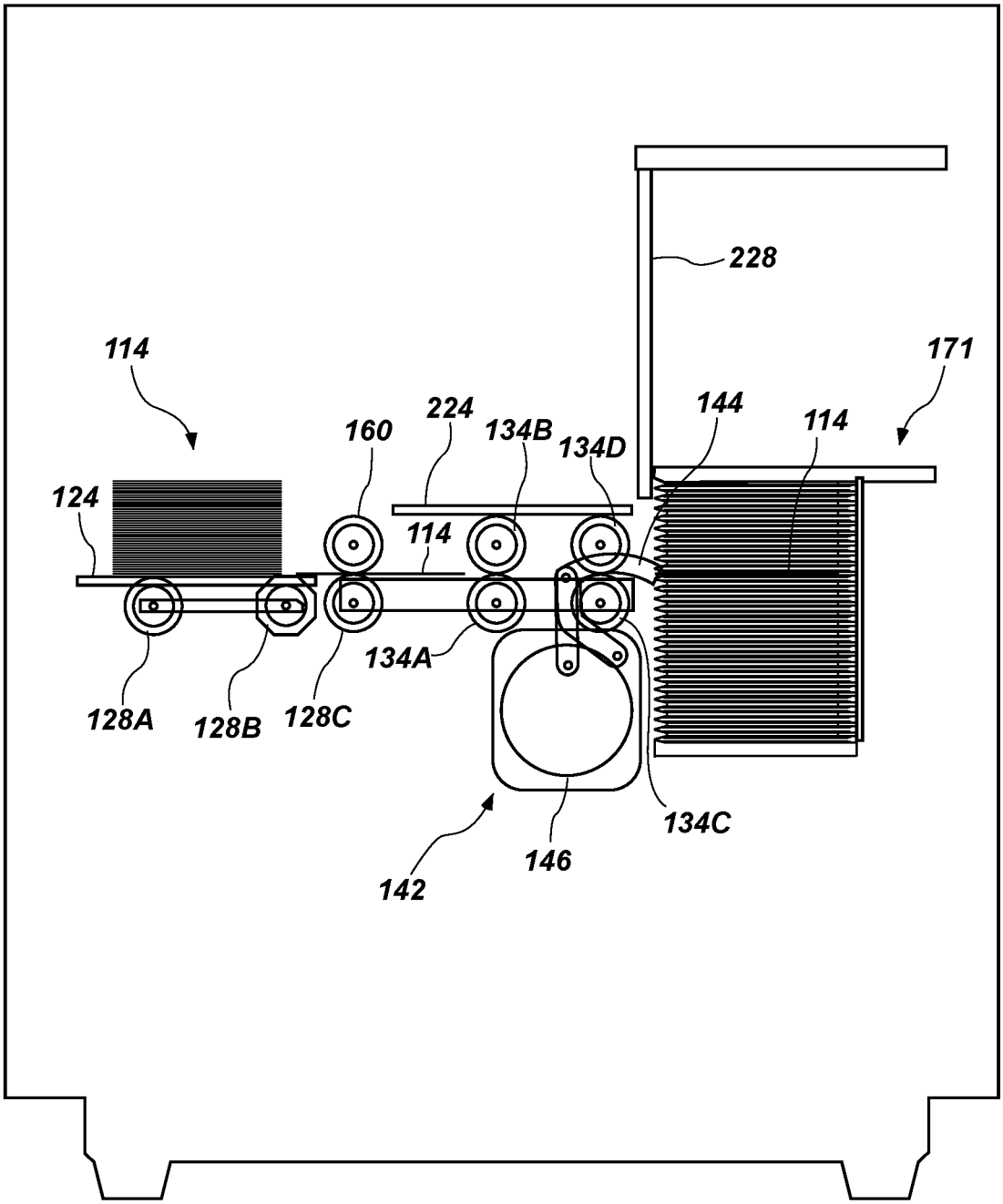
Figure 14E:
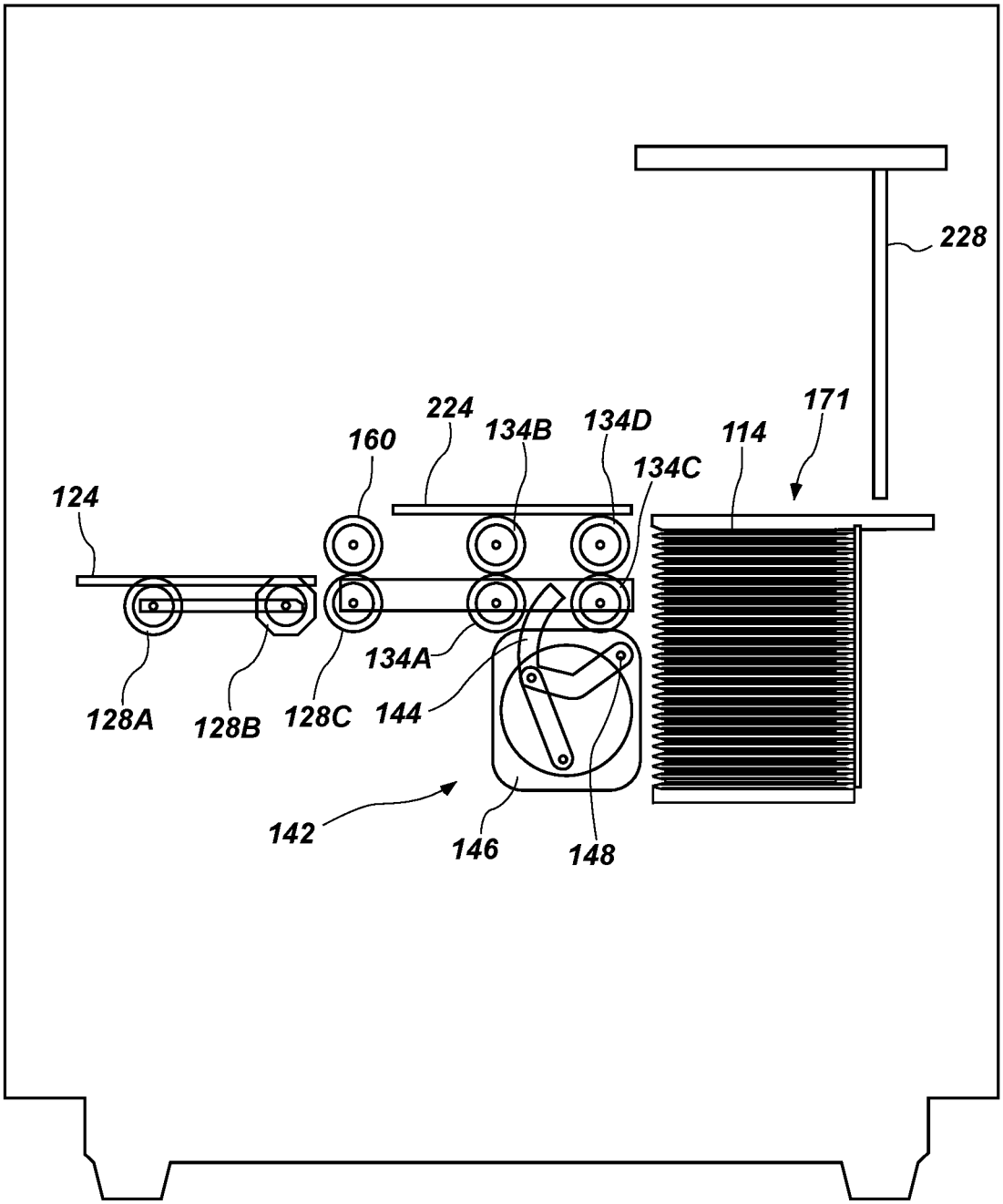

As shown in FIG. 14D, the control system 280 then may actuate the card packer arm 144 of the card packing device 142 using the packer motor 146, as indicated at action 420 in FIG. 15, which ensures that the card 114 is fully inserted within the corresponding card storage compartment 172 in the rack 171, as previously discussed. The control system 280 then determines whether or not the number of cards that have been inserted into the rack 171 corresponds to the initial total number of cards in the stack of cards 114 on the card support 124. If not, the control system 280 repeats actions 410 through 420, as indicated at action 422 in FIG. 15, until all cards 114 have been inserted into the rack 171, as shown in FIG. 14E. If the number of cards 114 that have been inserted into the rack 171 corresponds to the initial total number of cards in the stack of cards 114 on the card support 124, the control system 280 then determines whether any cards 114 unexpectedly remain present on the card support 124 using the card sensor 310 as indicated at action 424. If so, the card shuffler 100 ceases operation and an error message may be displayed on the data output device 296 (FIG. 13), as indicated in action 426 in FIG. 15. If not, the control system 280 unloads the cards 114 from the rack 171 as indicated at action 428 in FIG. 15 and described below.

As previously mentioned, the ejector 228 may be positioned by the control system 280 on the side of the rack 171 adjacent the card support 224 of the output elevator 222 and the speed-up rollers 134A-134D (as shown in FIGS. 14A-14D) during the shuffling operation while the rack 171 moves vertically up and down and cards 114 are inserted into the rack 171 by the card input mechanism 120. Once all cards 114 have been inserted into the rack 171 and the set of cards has been verified for accuracy and completion by the control system 280 using the card imaging system 250, the cards 114 may be ejected out from the rack 171 using the ejector 228. The control system 280 may cause the rack 171 to move vertically downward to the lowermost position to provide clearance to horizontally move the ejector 228 over the rack 171 to a position on a side of the rack 171 opposite the card support 224 of the output elevator 222, as shown in FIG. 14E.

Figure 14F:
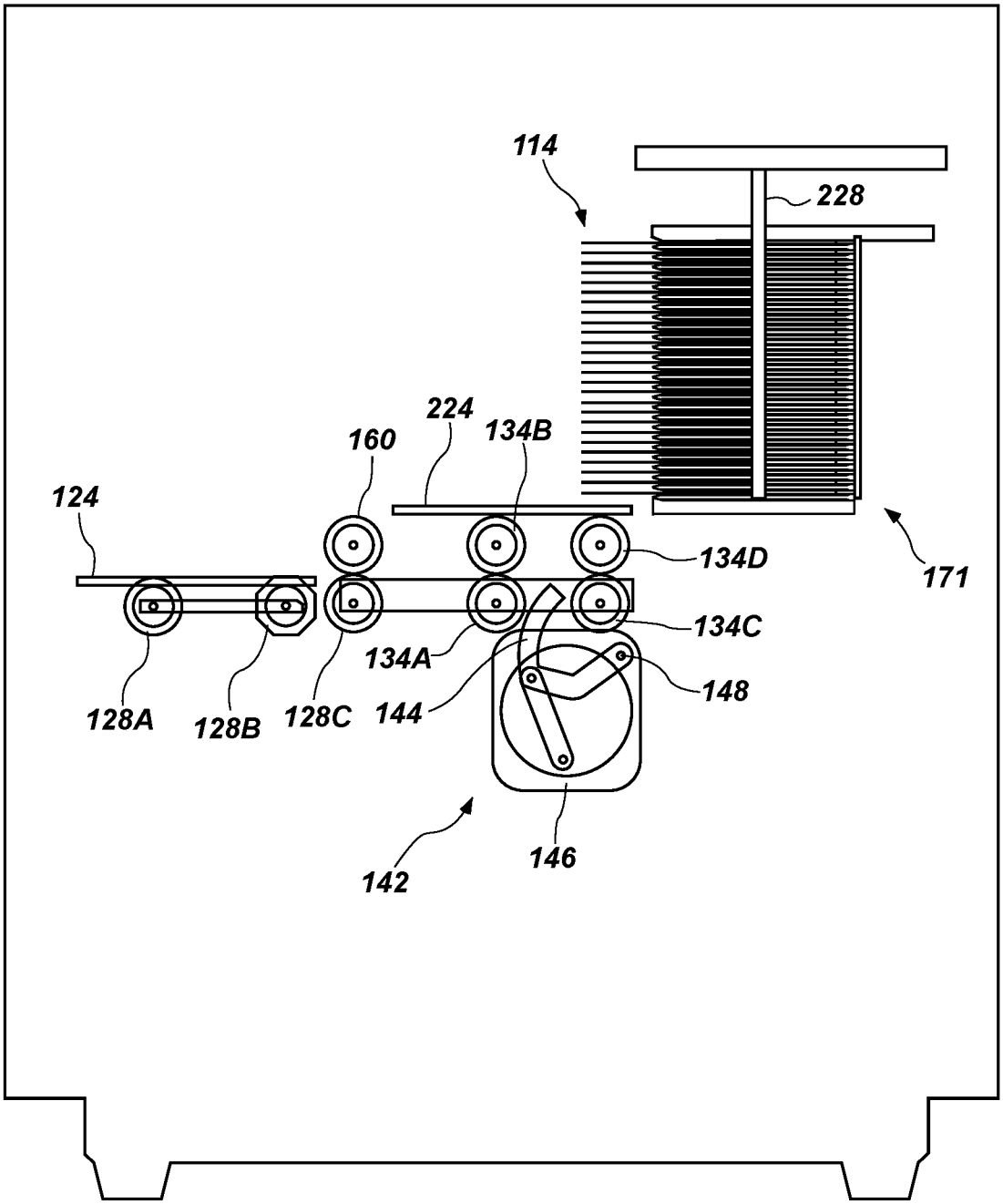
Figure 14G:
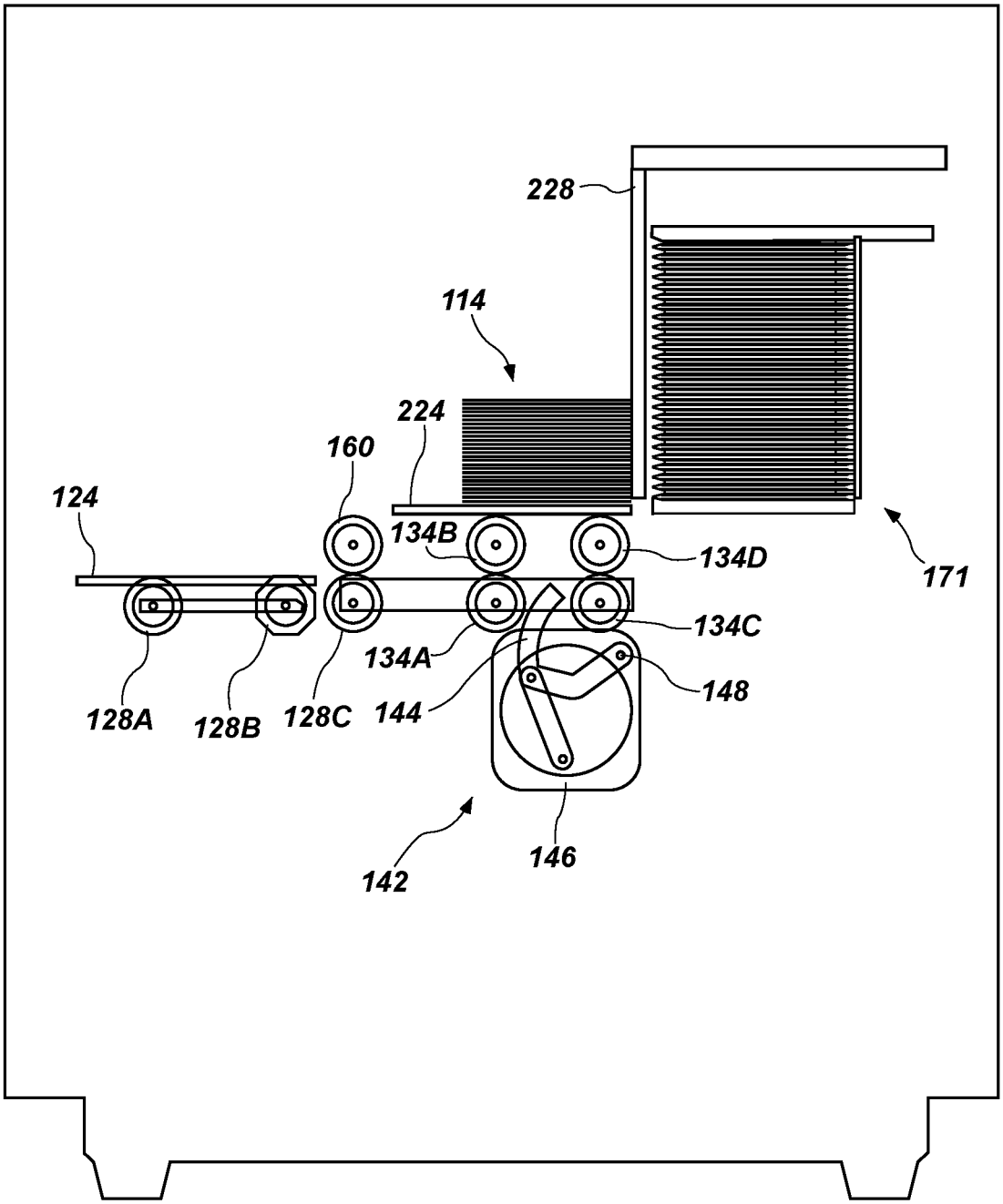

Referring to FIG. 14F, the control system 280 then may cause the rack 171 to move in the vertically upward direction to the uppermost position of the rack 171 while the ejector 228 remains positioned on the side of the rack 171 opposite the card support 224 of the output elevator 222. Upon moving the rack 171 to the uppermost position, the ejector 228 may be disposed laterally adjacent the rack 171 on the side thereof opposite the card support 224. The control system 280 then may cause the ejector 228 to move in the horizontal direction laterally toward the card support 224. As the ejector 228 moves in the horizontal direction toward the card support 224, the ejector 228 abuts against the edges of the cards 114 opposite the card support 224, passes through a central void 189 between the side brackets 178A, 178B (FIG. 7) and pushes the cards 114 out from the card storage compartments 172 and onto the card support 224 of the card output elevator 222 in the form of a stack of shuffled cards 114 (FIG. 14G). The cards may be simultaneously ejected out from the rack 171 together as a batch and onto the card support 224. FIG. 14F illustrates the ejector 228 at a midpoint in the ejection process at which the ejector 228 is disposed within the rack 171 and the cards 114 are partially ejected out from their respective card storage compartments 172 in the rack 171 by the ejector 228.

Figure 14H:
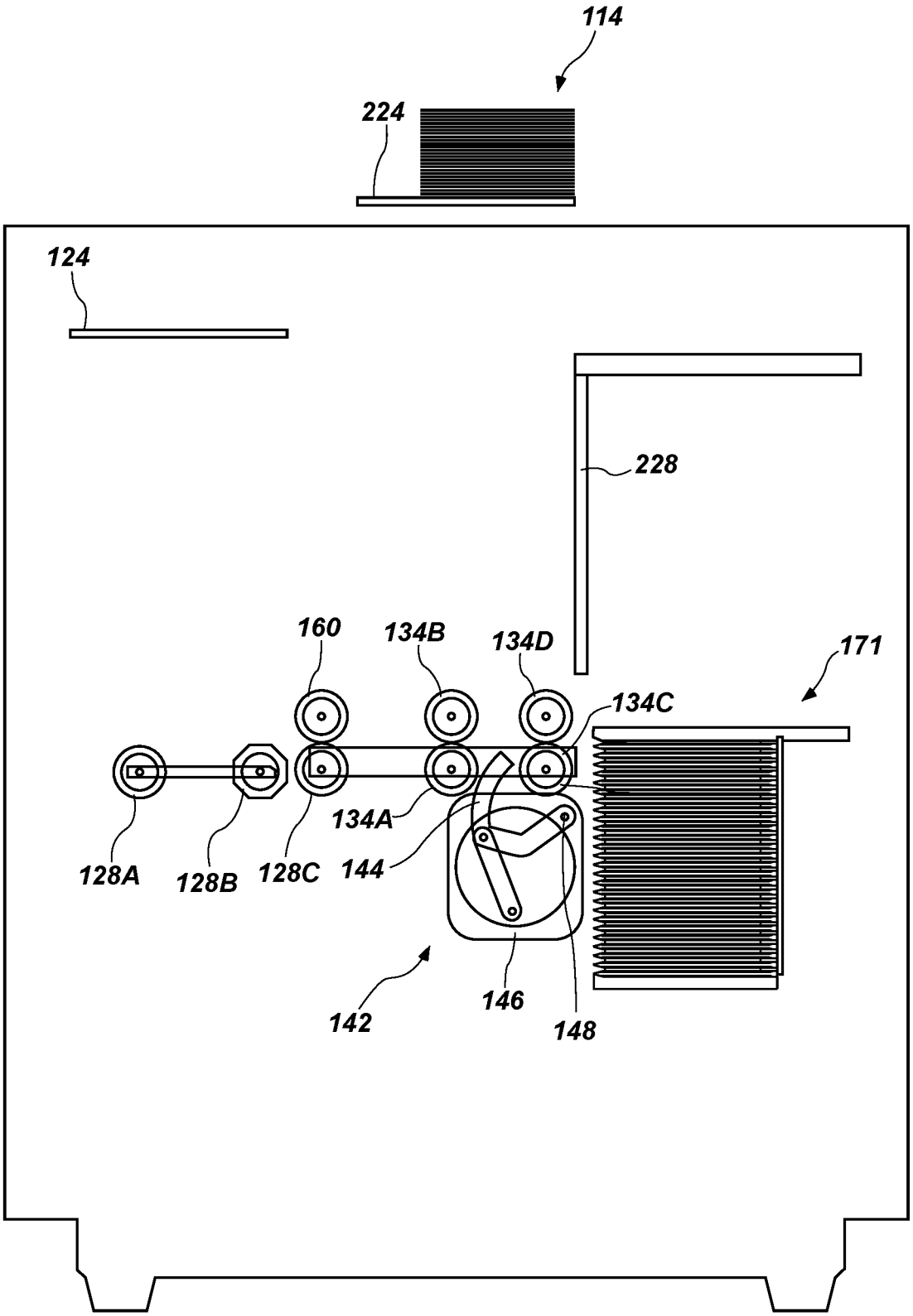

FIG. 14G illustrates the cards 114 completely ejected out from the rack 171 and dropped onto the card support 224 by the ejector 228. As shown in FIG. 14G, the cards 114 have dropped onto the card support 224 in the form of a stack of shuffled cards 114. After the cards 114 are ejected onto the card support 224, the control system 280 may cause the output elevator 222 and the input elevator 122 to move vertically upward to the uppermost positions, as shown in FIG. 14H, and to raise the lid 112, as shown in FIG. 2. The control system 280 may detect when a user removes the stack of shuffled cards 114 from the card support 224 of the output elevator 222 using the card sensor 328. Once the stack of shuffled cards 114 is removed from the card support 224, the control system 280 may wait a predetermined amount of time (e.g., five seconds) for a user to place another stack of cards 114 onto the card support 124 of the card input elevator 122. In other embodiments, another stack of cards may be inserted while the shuffler is shuffling so that as soon as a shuffled group of cards is elevated, the next set of cards can be processed. If cards are removed from the card support 224 and cards are placed on the card support 124 within the predetermined amount of time, the control system 280 may cause the card input elevator 122 and the card output elevator 222 to move vertically downward to the lowermost positions and close the lid 112, and to then wait for a user to again press the start button 299 (FIGS. 1 and 2) to use the card shuffler 100 in shuffling cards, as indicated at action 430 in FIG. 15. After the start button 299 is pushed by a user, the control system 280 may again cause the output elevator 222 and the input elevator 122 to move vertically upward to the uppermost positions and to raise the lid 112, as indicated at action 434 in FIG. 15.

Upon first raising the input elevator 122 and the output elevator 222 to the uppermost positions immediately after cards are unloaded from the rack 171 onto the card support 224, if cards are removed from the card support 224 and additional cards are placed on the card support 124 within the predetermined amount of time, the card shuffler 100 may automatically commence another shuffling operation and return to action 402 in FIG. 15 to shuffle the additional stack of cards 114 placed on the card support 124 without requiring the user to press the start button 299 (FIGS. 1 and 2) for each shuffling operation. Thus, the card shuffler 100 may be used repeatedly to shuffle stacks of cards 114 automatically and continuously simply by placing stacks of cards 114 to be shuffled on the card support 124 of the input elevator 122 and removing stacks of shuffled cards 114 from the card support 224 of the output elevator 222 between shuffling operations.

As previously mentioned, the card shuffler 100 also may be used to sort cards in a stack of cards placed on the card support 124 of the card input elevator 122 into a predefined order, such as a sequential "new deck" order for a standard deck of playing cards. The card shuffler 100 may be placed in a sort mode of operation (and/or a shuffle mode of operation) using the data input device 294 of the control system 280. When the card shuffler 100 is in the sort mode, the start button 299 (FIGS. 1 and 2) may be pressed to cause the input elevator 122 and the output elevator 222 to rise to the uppermost positions and open the lid 112. The stack of cards to be sorted may be placed on the card support 124 of the card input elevator 122. After the card sensor 310 detects the presence of the stack of cards on the card support 124 for a predetermined amount of time (e.g., five seconds), the control system 280 may automatically commence a sorting operation by lowering the input elevator 122 and the output elevator 222 to the lowermost positions and closing the lid 112.

Once the input elevator 122 and the output elevator 222 have moved to the lowermost positions with the stack of cards resting on the card support 124 of the input elevator 122, the card input mechanism 120 and the card imaging system 250 may be used to sequentially identify the rank and suit of the cards in the stack (using the card imaging system 250), and to respectively move the cards into predetermined positions within the rack 171 of the card storage device 170, such that the cards are ordered within the rack 171 in a predetermined, selected order in a direction extending from the top of the rack 171 to the bottom of the rack 171, or from the bottom of the rack 171 to the top of the rack 171.

To sort cards, the control system 280 of the card shuffler 100 may reference a Sort Table, which may be stored in a memory device 290 of the control system 280. The Sort Table correlates the identity of specific cards in a predefined set of cards (e.g., a deck of standard playing cards) to one of the fifty-four (54) card storage positions in the rack 171 in the predefined order (e.g., new deck order).

The control system 280 may selectively control movement of the various components of the card input mechanism 120 and the card storage device 170 to cause the cards in the stack of cards to be inserted into the rack 171 and positioned in their assigned card storage positions corresponding to the selected, predefined order. As previously described, the rack 171 is moved up and down in the vertical direction to a proper position relative to the speed-up rollers 134A-134D (which are disposed at a fixed, static location within the card shuffler 100) for insertion of each card into the appropriate card storage compartment 172 and into its assigned card storage position.

The Sort Table and the First and Second Rack Position Tables may be referenced and used by the control system 280 in controlling operation of the card input mechanism 120, the card imaging system 250, and the card storage device 170 to sequentially position each card into the appropriate card storage compartment 172 (and appropriate upper or lower card storage position therein) so as to position the cards in the rack 171 in the predefined, selected order. As a particular card is inserted into the rack 171, the control system 280 references the Sort Table to determine in which of the fifty-four (54) card storage positions the specific identified card is to be positioned. As previously discussed, the control system 280 determines whether there is already a card located in the respective card storage compartment 172 in which the card storage position is located. If there is not a card already present in the card storage compartment 172, the control system 280 references Table 2 to determine where to position the rack 171 such that, when the card is inserted into the rack 171 by the speed-up rollers 134A-134D, the card will be inserted into the center of the card storage compartment 172. If there is a card already present in the card storage compartment 172, the control system 280 references Table 3 to determine where to position the rack 171 such that, when the card is inserted into the rack 171 by the speed-up rollers 134A-134D, the card will be inserted either above or below the card already present in the card storage compartment 172. Thus, after selectively inserting the second card into any given card storage compartment 172 above or below the first card inserted into the card storage compartment 172, the two cards in the card storage compartment 172 will be appropriately positioned in the upper card storage position and the lower card storage position, respectively, in that card storage compartment 172.

After placing the cards in the rack 171 such that the cards are in the predetermined, selected order within the rack 171, the cards may be ejected out from the rack 171, as previously discussed, to place the stack of sorted cards onto the card support 224 of the card output elevator 222. The control system 280 then may cause the output elevator 222 and the input elevator 122 to move vertically upward to the uppermost positions and to raise the lid 112, thereby allowing a user to remove the stack of sorted cards from the card support 224 of the card output elevator 222.

The example embodiments of the disclosure described above do not limit the scope of the invention, since these embodiments are merely examples of embodiments of the invention, which is defined by the scope of the appended claims and their legal equivalents. Any equivalent embodiments are intended to be within the scope of this invention. Indeed, various modifications of the disclosure, in addition to those shown and described herein, such as alternate useful combinations of the elements described, will become apparent to those skilled in the art from the description. Such modifications and embodiments are also intended to fall within the scope of the appended claims, including legal equivalents.

What is claimed is:

1. A card-handling device, comprising: a card input mechanism;

a temporary card storage area positioned to receive cards from the card input mechanism, the temporary card storage area comprising storage compartments distributed longitudinally along a rack;

a card output mechanism configured to eject cards from the temporary card storage area; and a card size adjustment member attached to the rack and extending along a lateral side of each storage compartment, the card size adjustment member being movable between a first lateral position in which the card size adjustment member defines a first width of each of the storage compartments and a second lateral position in which the card size adjustment member defines a second, different width of each of the storage compartments, as measured in an at least substantially horizontal plane when the card-handling device is oriented for use.

2. The card-handling device of claim 1, wherein the card size adjustment member comprises a projection positioned to contact cards when the cards are inserted into the temporary card storage area.

3. The card-handling device of claim 2, wherein the projection is positioned to contact an edge of each card when the cards are inserted into the temporary card storage area.

4. The card-handling device of claim 2, wherein the projection is movable between a first orientation in which the projection defines the first width and a second orientation in which the projection defines the second width.

5. The card-handling device of claim 1, wherein the card size adjustment member is further movable between a first position in which the card size adjustment member defines a first height of each of the storage compartments and a second position in which the card size adjustment member defines a second, different height of each of the storage compartments.

6. The card-handling device of claim 1, further comprising a sensor positioned and configured to detect whether the card size adjustment member is in the first lateral position or the second lateral position.

7. The card-handling device of claim 6, wherein the sensor comprises a Hall effect sensor.

8. The card-handling device of claim 7, wherein the card size adjustment member comprises a magnet positioned to enable the Hall effect sensor to detect whether the card size adjustment member is in the first lateral position or the second lateral position.

9. The card-handling device of claim 1, wherein a difference between the first width and the second width is 0.25 inch.

10. The card-handling device of claim 9, wherein the first width is 2.5 inches and the second width is 2.25 inches.

11. The card-handling device of claim 1, wherein the card output mechanism comprises a movable ejector configured to simultaneously eject cards out from at least two card storage compartments of the temporary card storage area.

12. The card-handling device of claim 11, wherein the movable ejector is configured to simultaneously eject cards out from all card storage compartments of the temporary card storage area.

13. The card-handling device of claim 11, wherein each card storage compartment is sized and configured to hold two cards therein and to prevent insertion of more than two cards therein.

14. The card-handling device of claim 1, further comprising:

a first touch screen display configured to regulate operation of the card-handling device, the first touch screen display located within the card-handling device such that the first touch screen display is inaccessible to a user from outside the card-handling device during normal use; and a second touch screen display configured to regulate operation of the card-handling device, the second touch screen display located at least partially at an exterior of the card-handling device such that the second touch screen display is accessible to a user from outside the card-handling device during normal use.

15. A method of using a card-handling device, comprising: positioning a card size adjustment member in a first lateral position or a second lateral position, the card size adjustment member defining a first width of each storage compartment of a temporary card storage area when the card size adjustment member is in the first lateral position, the card size adjustment member defining a second, different width of each of the storage compartments of the temporary card storage area when the card size adjustment member is in the second lateral position, as measured in an at least substantially horizontal plane when the card-handling device is oriented for use; and moving a card into a card storage compartment utilizing a card input mechanism after positioning the card size adjustment member in the first lateral position or the second lateral position.

16. The method of claim 15, wherein moving the card into the card storage compartment comprises contacting an edge of the card to the card size adjustment member while moving the card into the card storage compartment.

17. The method of claim 15, further comprising moving the card size adjustment member from one of the first lateral position or the second lateral position to another of the first lateral position or the second lateral position.

18. The method of claim 17, further comprising detecting a change in position of the card size adjustment member utilizing a sensor positioned and configured to detect whether the card size adjustment member is in the first lateral position or the second lateral position.

19. The method of claim 17, wherein moving the card size adjustment member from the one of the first lateral position or the second lateral position to the other of the first lateral position or the second lateral position comprises displacing the card size adjustment member by 0.25 inch.

20. The method of claim 15, further comprising simultaneously ejecting cards out from at least two card storage compartments of the temporary card storage area.

* * * * *